US005992371A

United States Patent [19]

Raso

[11] Patent Number: 5,992,371

[45] Date of Patent: Nov. 30, 1999

[54] ROTARY PISTON MACHINE USABLE PARTICULARLY AS A THERMAL ENGINE

[76] Inventor: Roland Raso, Le Pre Catelan, Appartement 36-Batiment B, 82 allees Jean-Jaures, Toulouse, France

[21] Appl. No.: 08/693,046

[22] PCT Filed: Feb. 16, 1995

[86] PCT No.: PCT/FR95/00185

§ 371 Date: Dec. 24, 1996

§ 102(e) Date: Dec. 24, 1996

[87] PCT Pub. No.: WO95/22684

PCT Pub. Date: Aug. 24, 1995

[30] Foreign Application Priority Data

Feb. 18, 1994 [FR] France ..... 94 02076
Dec. 23, 1994 [FR] France ..... 94 15686

[51] Int. Cl.[6] ..... F02B 53/00

[52] U.S. Cl. ..... 123/245; 418/33

[58] Field of Search ..... 123/245; 418/33, 418/34, 35

[56] References Cited

U.S. PATENT DOCUMENTS 1,481,220 1/1924 Nichols .
3,294,071 12/1966 Turco ..... 418/35
4,281,628 8/1981 Doundoulakis ..... 418/34

FOREIGN PATENT DOCUMENTS 3430578 2/1986 Germany .
432751 8/1935 United Kingdom .

*Primary Examiner*—Michael Koczo
*Attorney, Agent, or Firm*—Harrison & Egbert

[57] ABSTRACT

A machine with rotary pistons having an engine unit with a cylindrical chamber, the engine having two rotors coaxially mounted in the cylindrical chamber. The first rotor is continuously rotationally driven. The second rotor is intermittently rotationally driven in a same direction as the first rotor. A transmission is connected between the rotors. This transmission includes an engaging member having a non-return mechanism. The non-return mechanism includes a first element fixed to the engine unit and a second element in engagement with the second rotor. The first and second elements are cooperative with each other through an angular blocking during the explosion and intake phase of the engine unit. The hydraulic pump has a rotor coupled to the first rotor and a stator coupled to the engine unit. A hydraulic motor is coupled to the second rotor and connected to the hydraulic pump by a hydraulic circuit. At least one valve is operatively connected to the engaging member. The valve serves to partially or totally open the hydraulic circuit during one phase of the engine unit and closes the hydraulic circuit during another phase of the engine unit. The opening or closing of the hydraulic circuit will engage or disengage the second rotor with respect to the first rotor.

33 Claims, 35 Drawing Sheets

94
93A
92
91
93
87
93A
88

ROTARY PISTON MACHINE USABLE PARTICULARLY AS A THERMAL ENGINE

The present invention relates to a rotary piston machine usable particularly as a thermal engine, of the internal combustion or diesel type, for example.

It is specified in the present application that half a revolution means a rotation along a 180 degree angle.

Engines are known which comprise several pairs of pistons rotationally driven about the axis of a power intake shaft, each pair of pistons determining a variable volume chamber in which the gas mixture is introduced during the intake phase. The rotation of the power intake shaft results from the gas expansion during the corresponding phase of the thermodynamic cycle. One of the two pistons is attached to the power intake shaft, the other piston being attached to a countershaft kinematically connected to the power intake shaft by a transmission of movement. The power intake shaft and the countershaft are coaxially mounted in one another and the transmission of movement induces an alternating rotational movement of the countershaft with respect to the power intake shaft, such that the volume of the chamber determined by each pair of pistons varies alternately between a minimum and a maximum, consistently with the phases of the thermodynamic cycle used.

A plurality of solutions have been proposed for obtaining the transmission of movement between the power intake shaft and the countershaft. Thus, one has proposed a transmission using elliptical toothed wheels, which are complex to manufacture, or off-centered toothed wheels whose unbalance must be compensated for by balancing weights, which increases the number of moving masses. One has also proposed transmissions of movement comprising two planet gears cooperating by meshing with a central gear and each affixed to a crank and connecting rod system inducing an angular reciprocating motion on the countershaft, by means of a radial arm. Balancing weights are also necessary with such a solution, the crank and connecting rod systems being, by their constitution, unbalance effect generators. In addition, these additional weights are positioned at a distance from an axis of rotation, which contributes to reduce the efficiency of the engine.

One also knows from the state of the art engines equipped with two rotors mounted with an interpenetration configuration, the motion of one being continuous, whereas the motion of the other occurs intermittently. This type of engine comprises a disengageable means for activating the second rotor, said means being constituted by a transmission of movement between the first rotor and the second rotor.

It has appeared that the solutions proposed for obtaining the transmission of movement are not satisfactory.

The object of the present invention is to resolve the aforementioned problems, and the invention is related to an engine of the aforementioned type including an engine unit 1 in which a cylindrical chamber 2 is provided wherein are coaxially mounted two rotors 5, 8, with an interpenetration configuration, and which form with said chamber at least one working chamber to rotate about the geometrical axis of the cylindrical chamber 2, and in which a gas mixture prevails according to the phases of a thermodynamic cycle, one of the two rotors, rotor 5, being continuously rotationally driven, whereas the other, rotor 8, is intermittently rotationally driven in the same direction as the first, said machine further comprising:

a disengageable means for rotationally actuating the second rotor, constituted by a means for transmitting movement between the rotor 5 and the rotor 8, coupled to the first rotor 5, on the one hand, and to the rotor 8, on the other hand, said transmission means, on the kinematic chain for transmitting movement between the rotor 5 and the rotor 8, comprising an engaging member.

This machine is essentially characterized in that it is provided with an non-return mechanism comprising a first element 12 fixed to the engine unit 1 and a second element 13 in engagement with the intermittent rotor 8, said elements 12, 13 cooperate with one another through an angular blocking during the explosion and intake phases, to prevent the reverse movement of the intermittently driven rotor 8, and that the means for transmitting movement between the rotor 5 and the rotor 8 is constituted by:

a hydraulic pump 24 coupled, through its rotor, to the rotor 5, and through its stator, to the engine unit;

a hydraulic motor 25 coupled to the rotor 8 and connected to the hydraulic pump by means of a loop-through or hydrostatic transmission hydraulic circuit;

at least one valve constituting the engaging member which, during the explosion and intake phases, partially or totally opens the hydraulic circuit between the motor and the pump, and closes it during the compression and exhaust phases, the total or partial opening leading to a disengagement and the closure to an engagement.

Other advantages and characteristics of the invention will become apparent upon reading the description of a preferred embodiment of the invention, with reference to the annexed drawings, in which.

Figure 1:
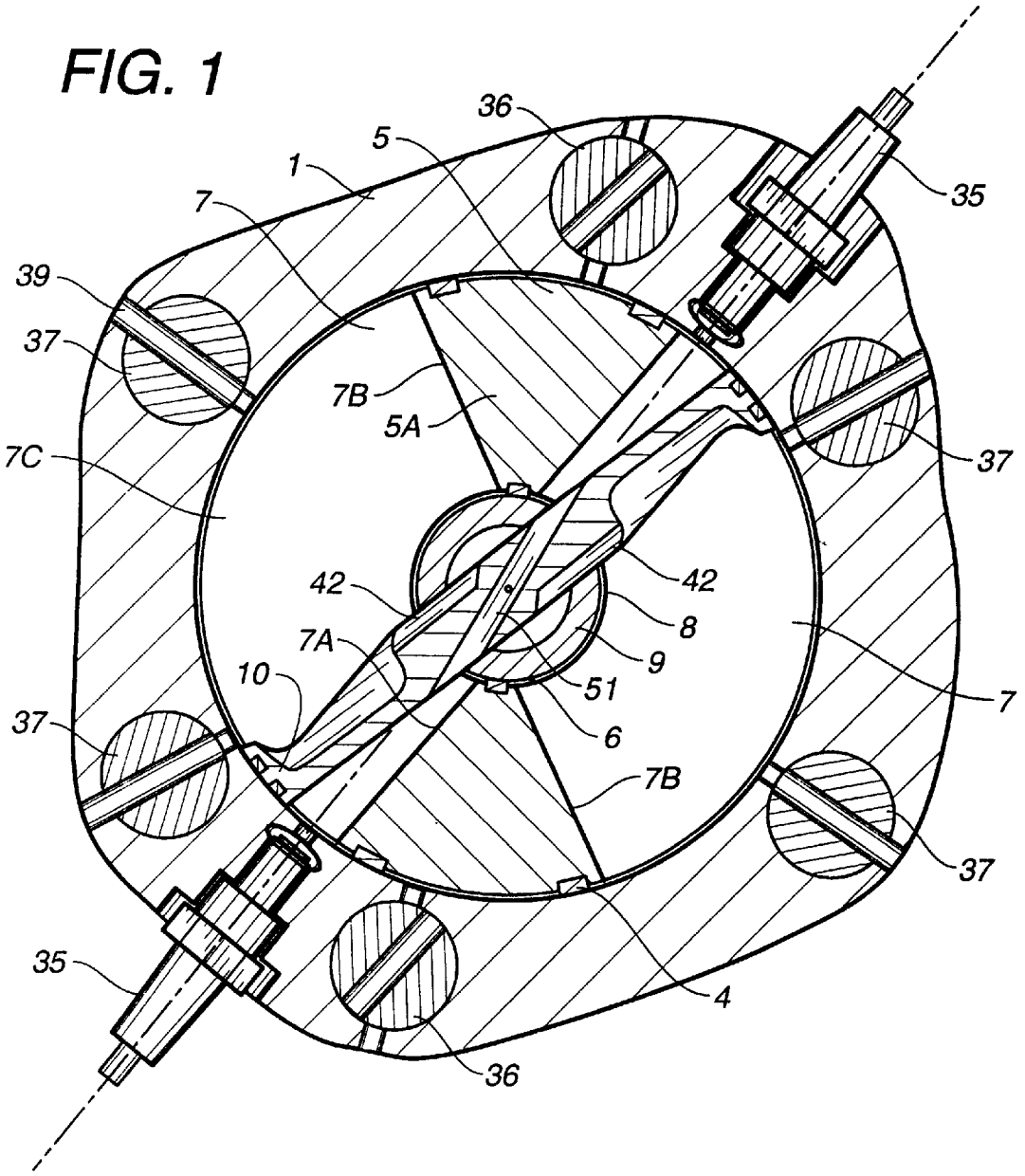
FIG. 1 is a transverse cross-sectional view of an engine according to a first embodiment.
Figure 2:
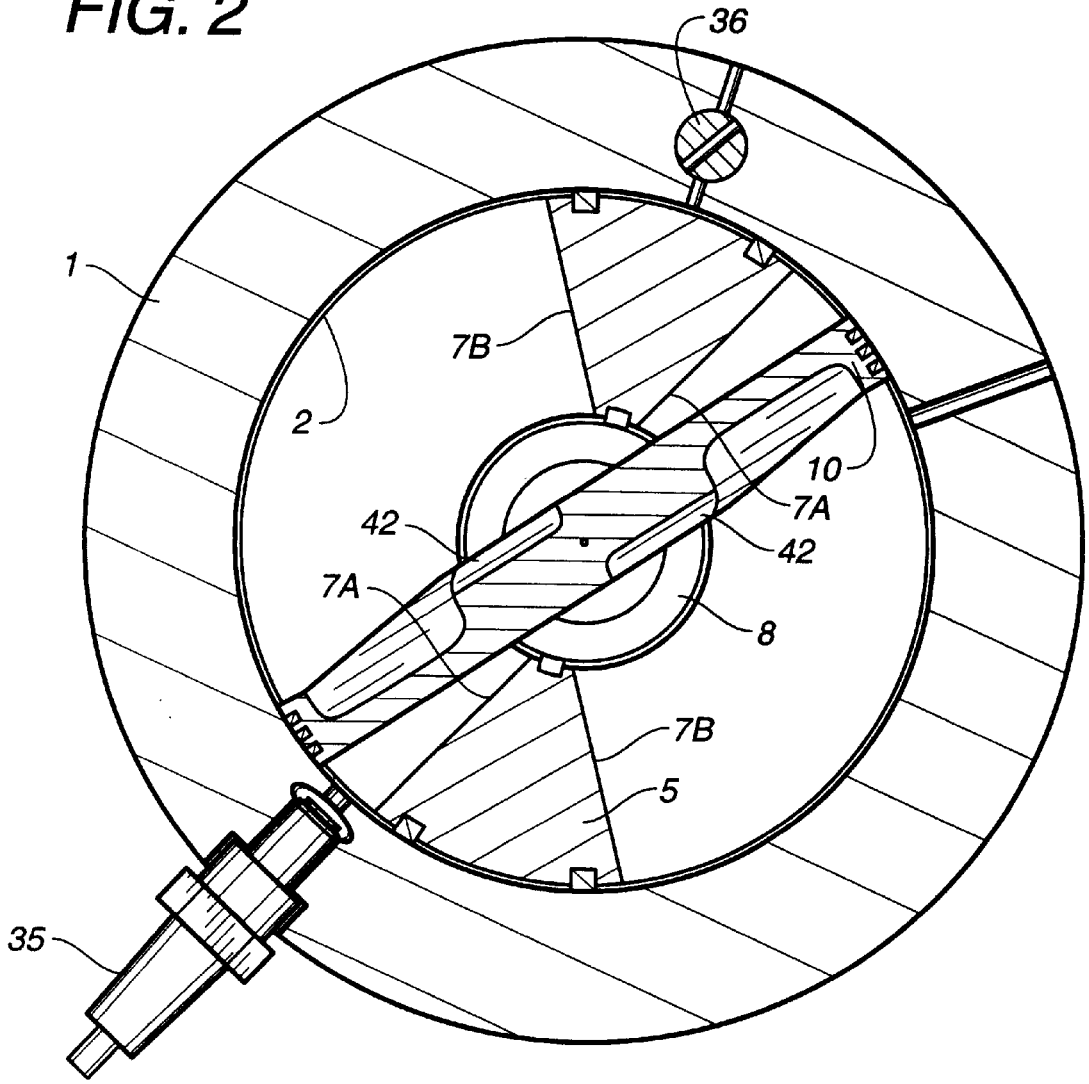
FIG. 2 is a transverse cross-sectional view of an engine according to a second embodiment.
Figure 14:
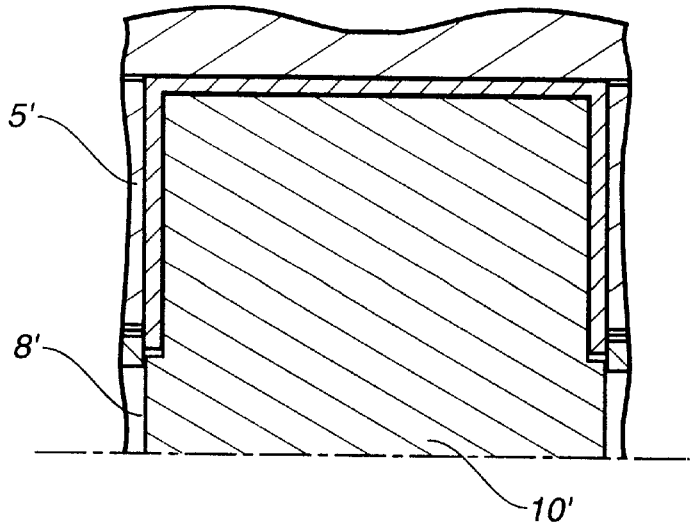
Figure 15:
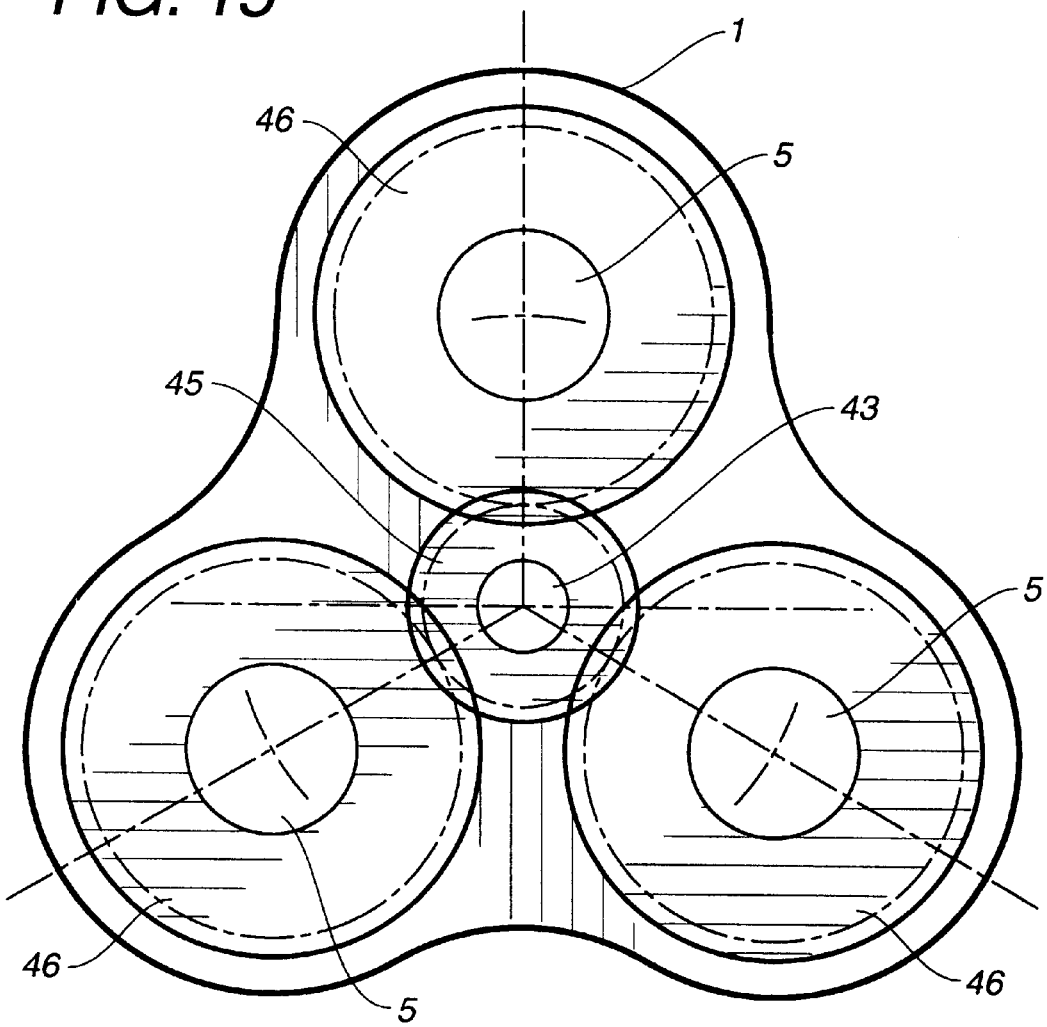
Figure 16:
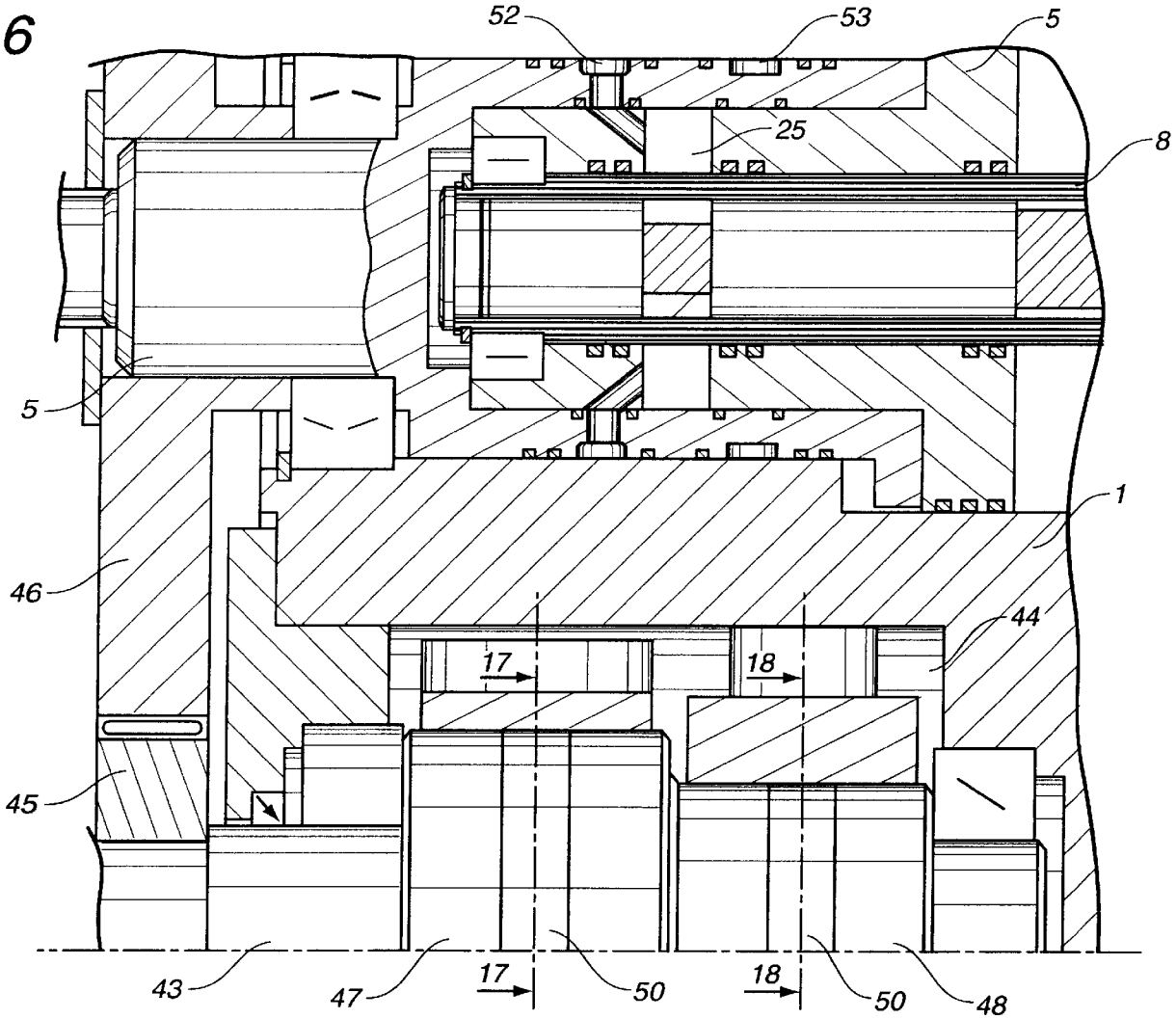
Figure 17:
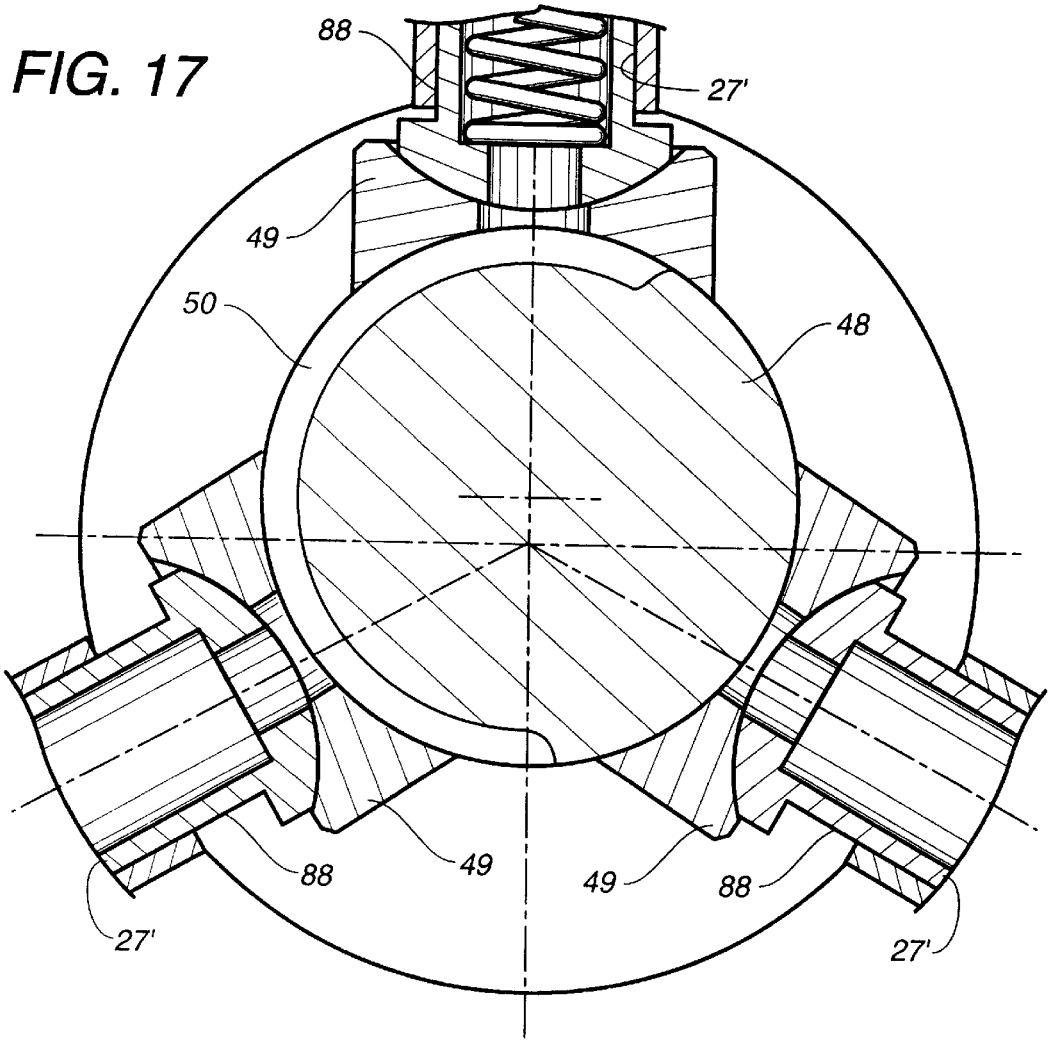
Figure 18:
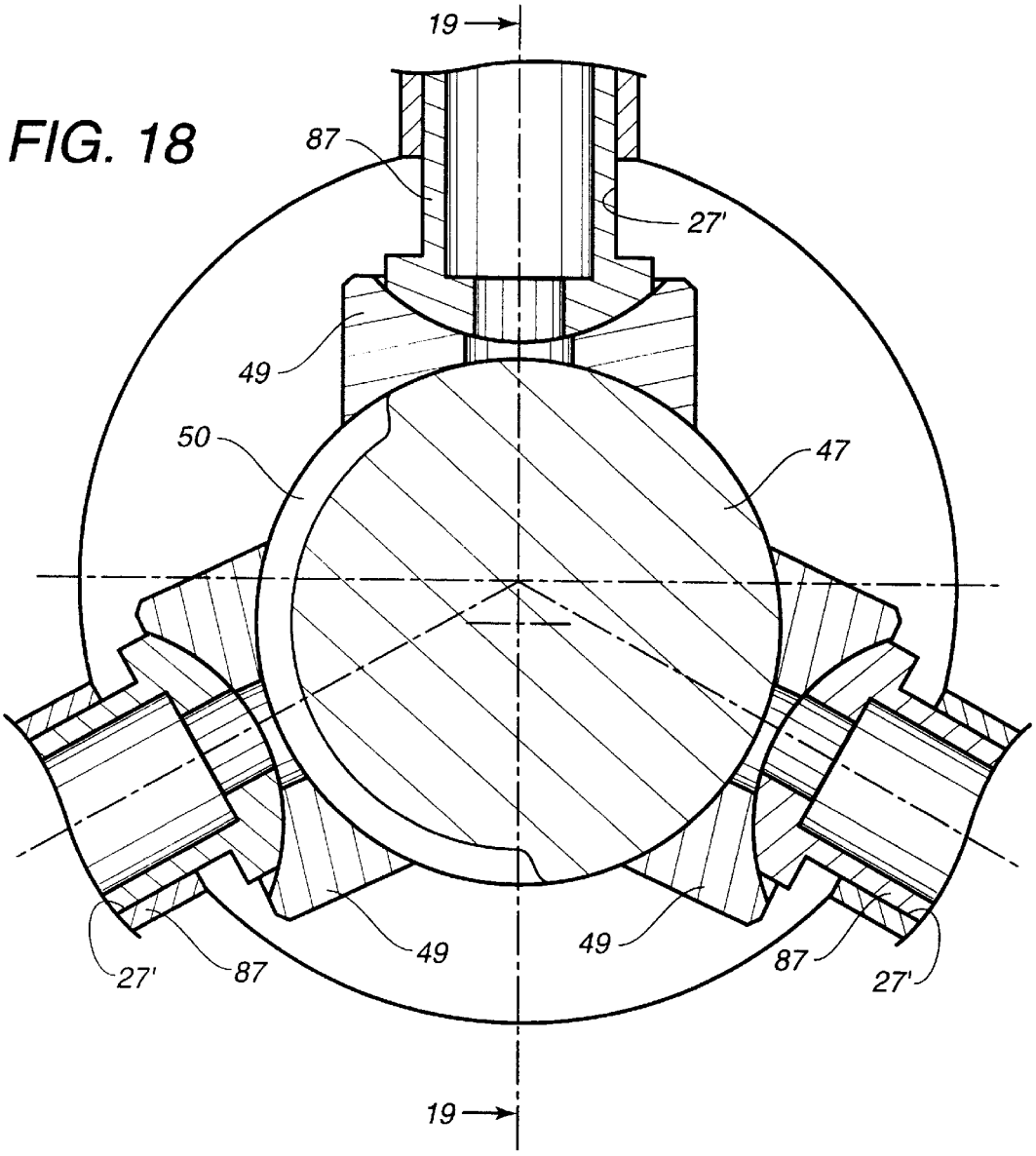
Figure 19:
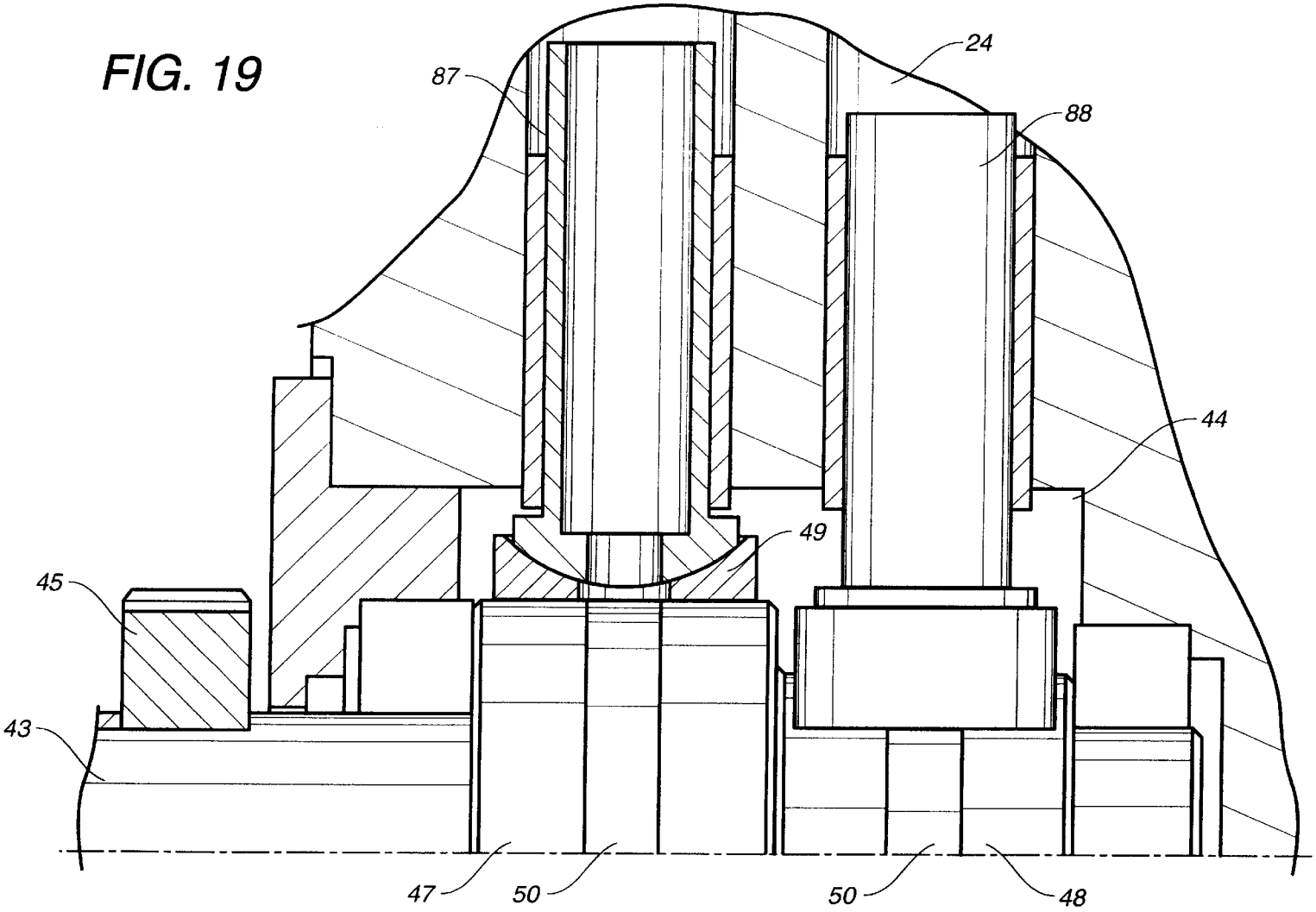
Figure 20:
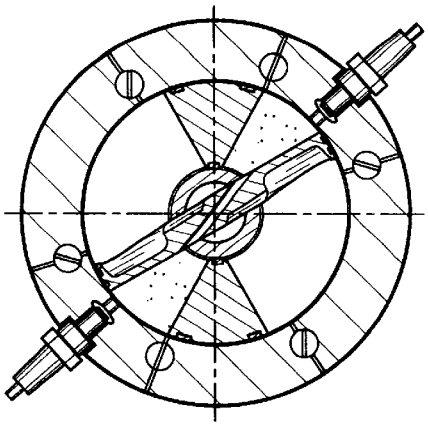
Figure 23:
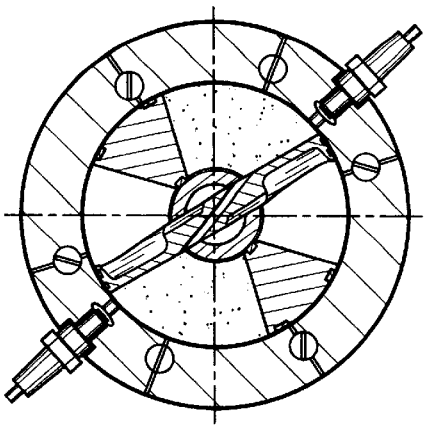
Figure 21:
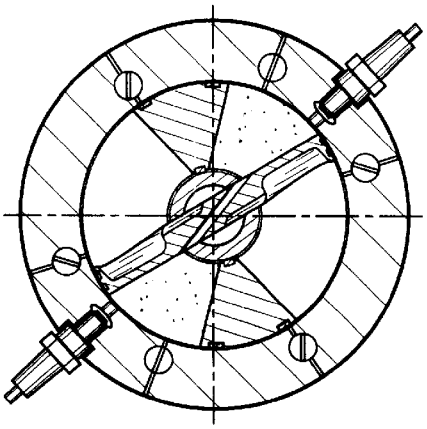
Figure 24:
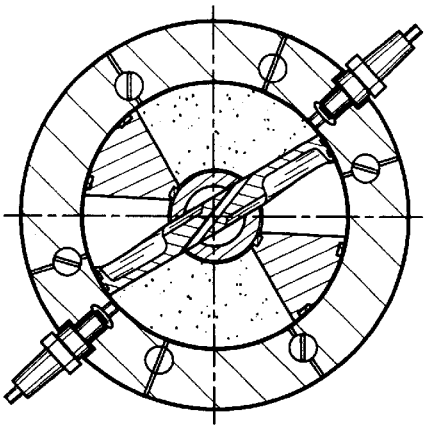
Figure 22:
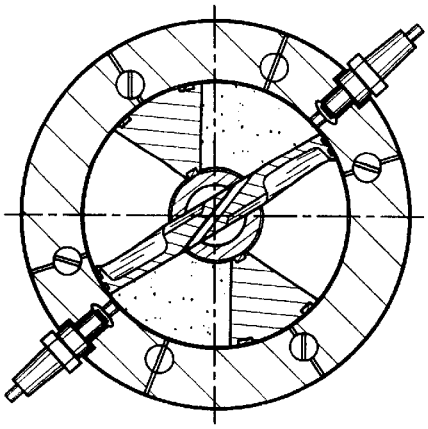
Figure 25:
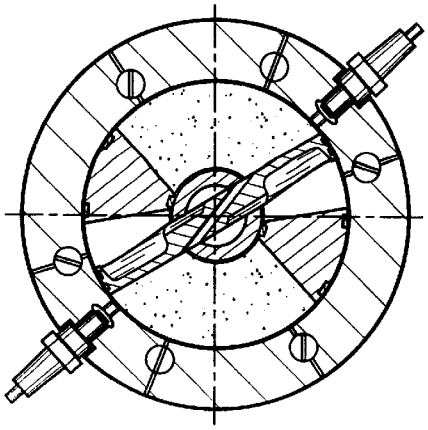
Figure 26:
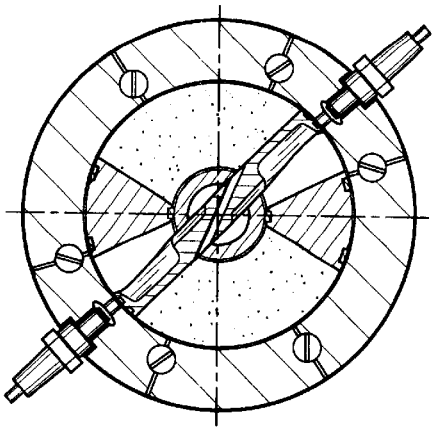
Figure 29:
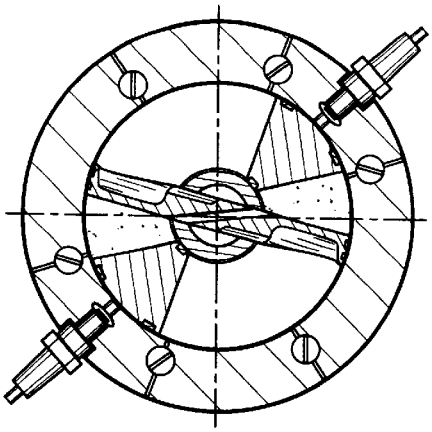
Figure 27:
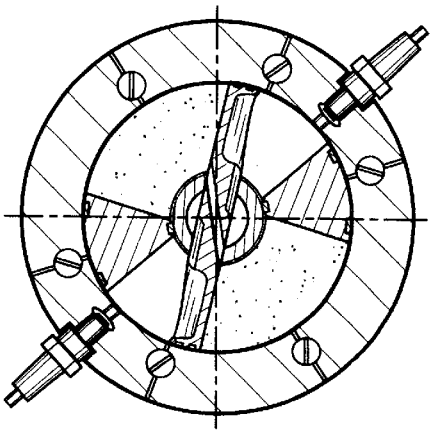
Figure 30:
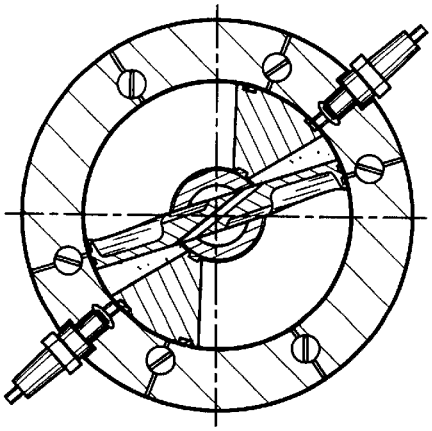
Figure 28:
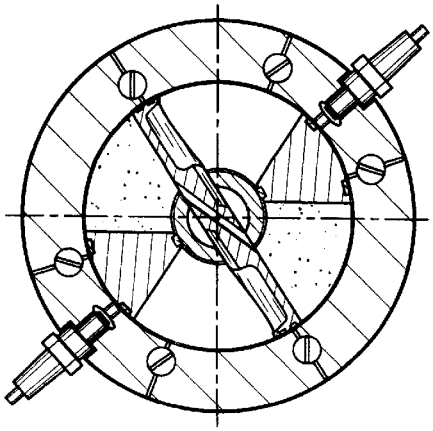
Figure 31:
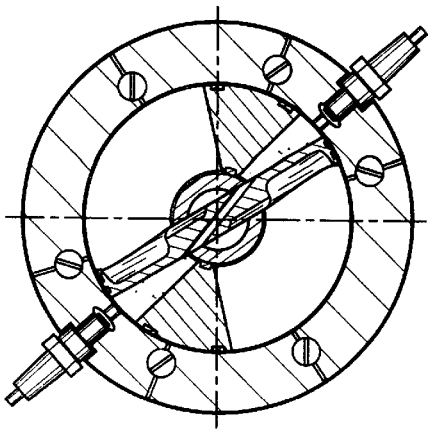
Figure 32:
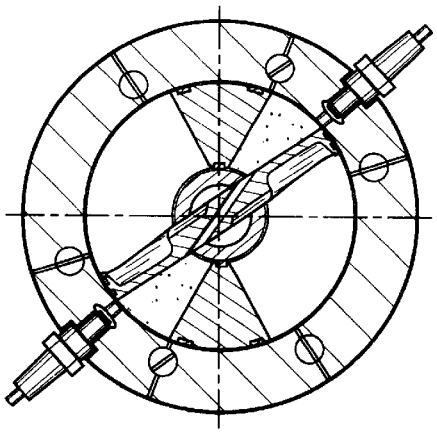
Figure 35:
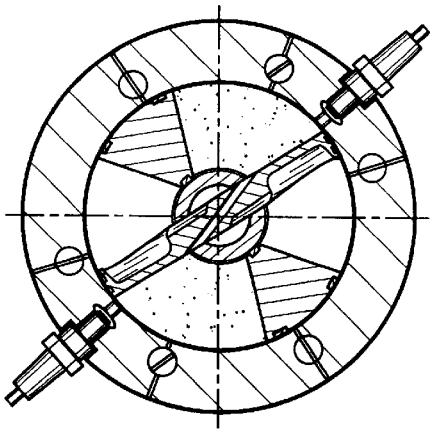
Figure 33:
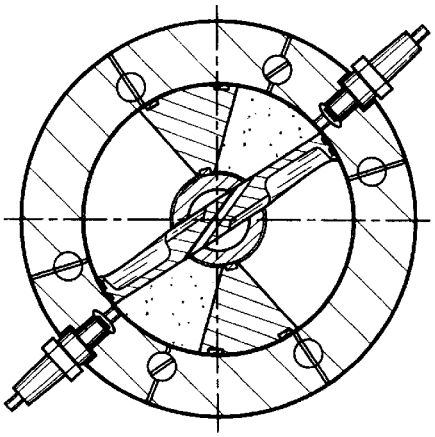
Figure 36:
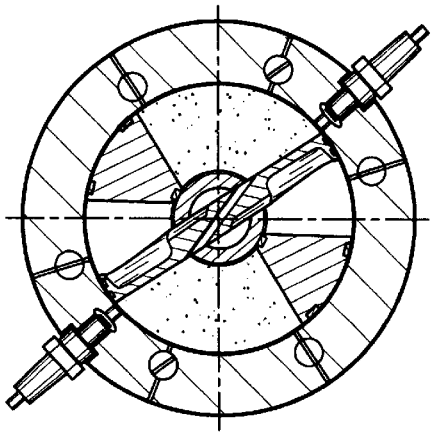
Figure 34:
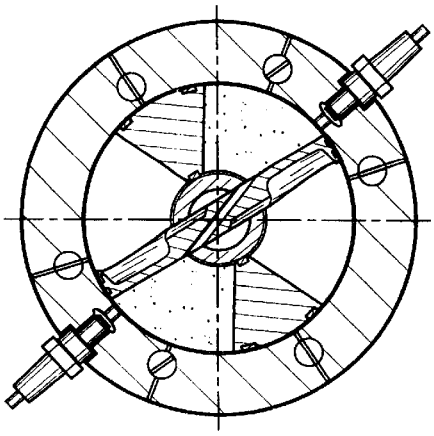
Figure 37:
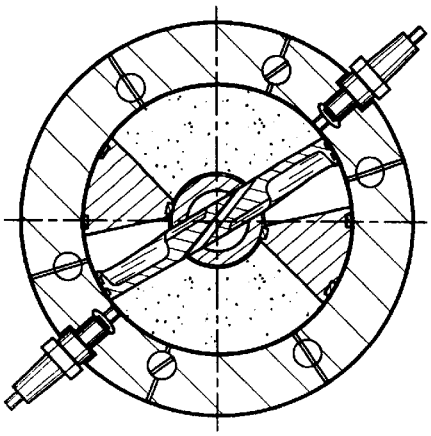
Figure 38:
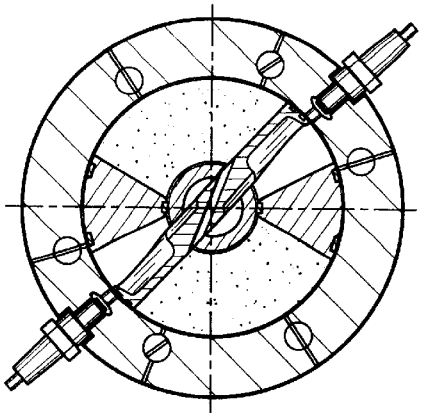
Figure 41:
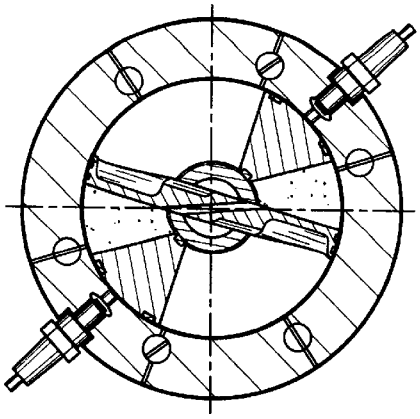
Figure 39:
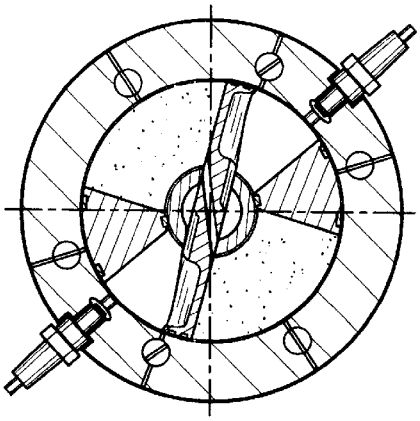
Figure 55:
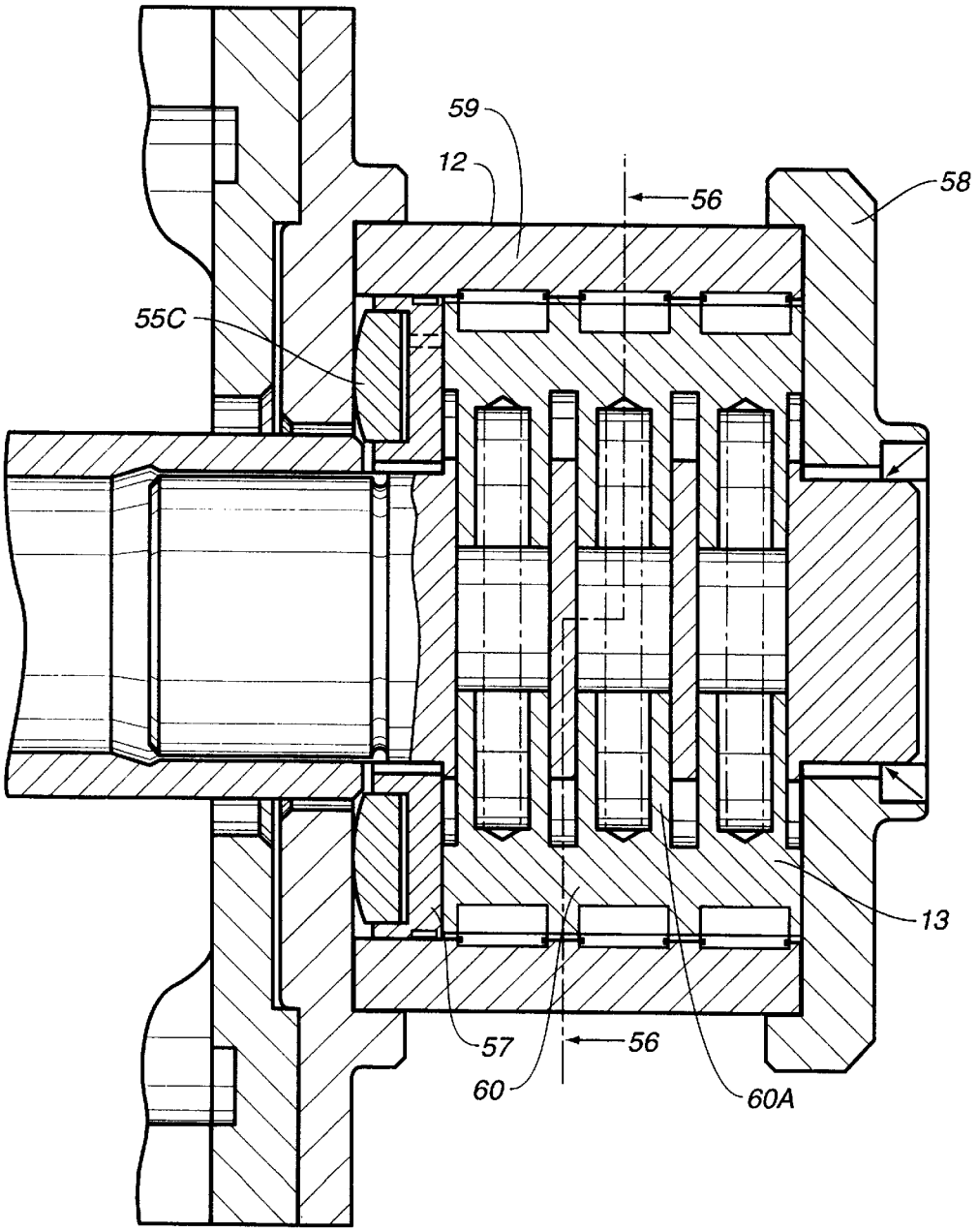
Figure 56:
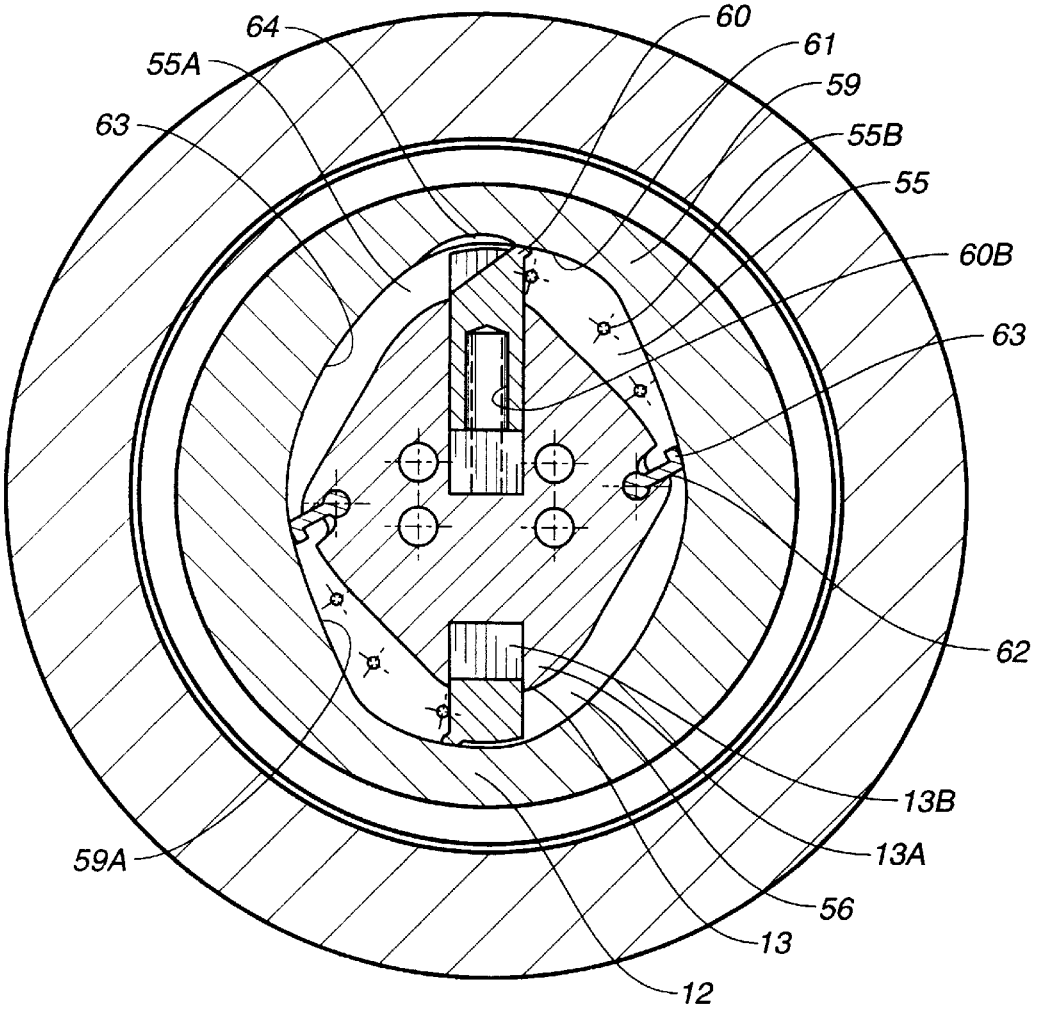
Figure 57:
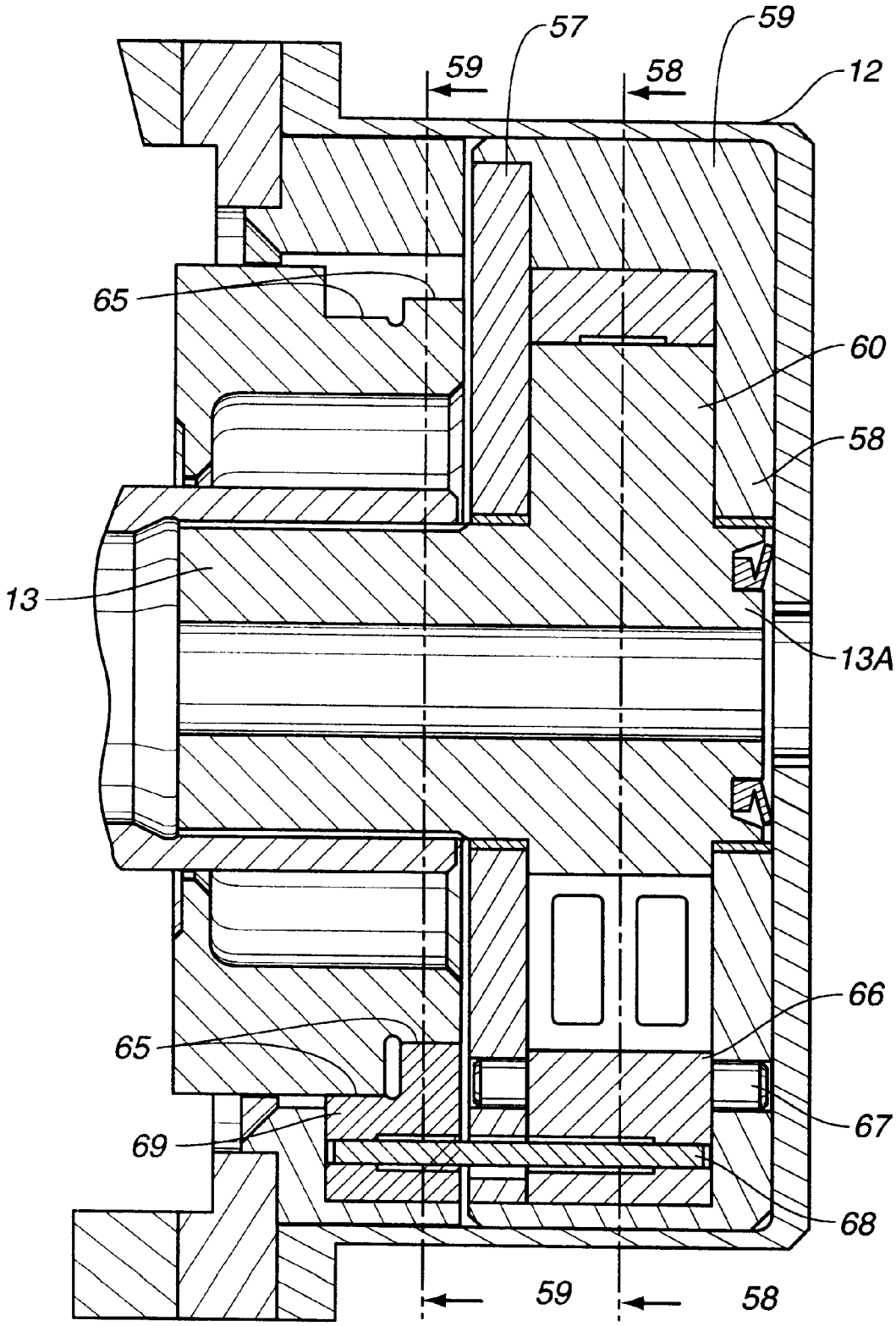
Figure 58:
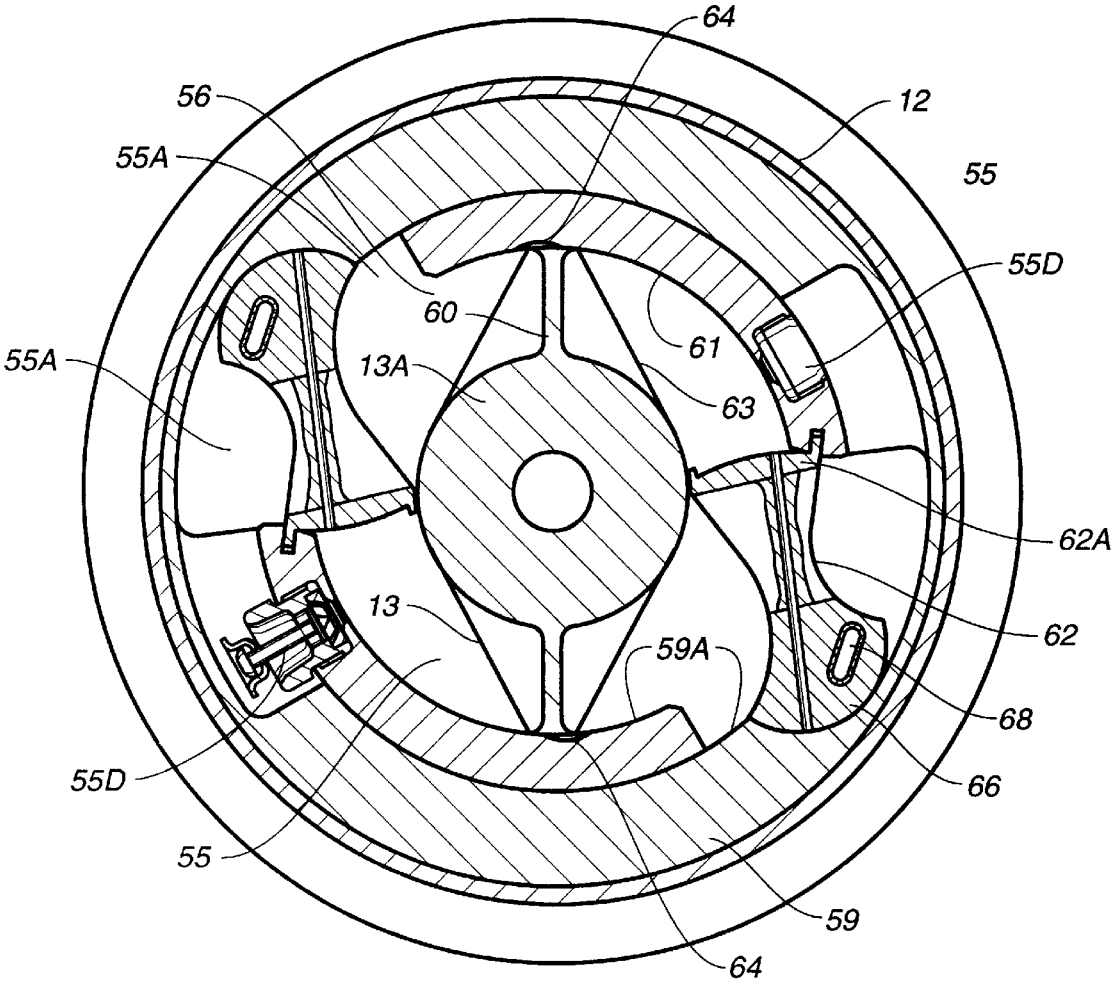
Figure 59:
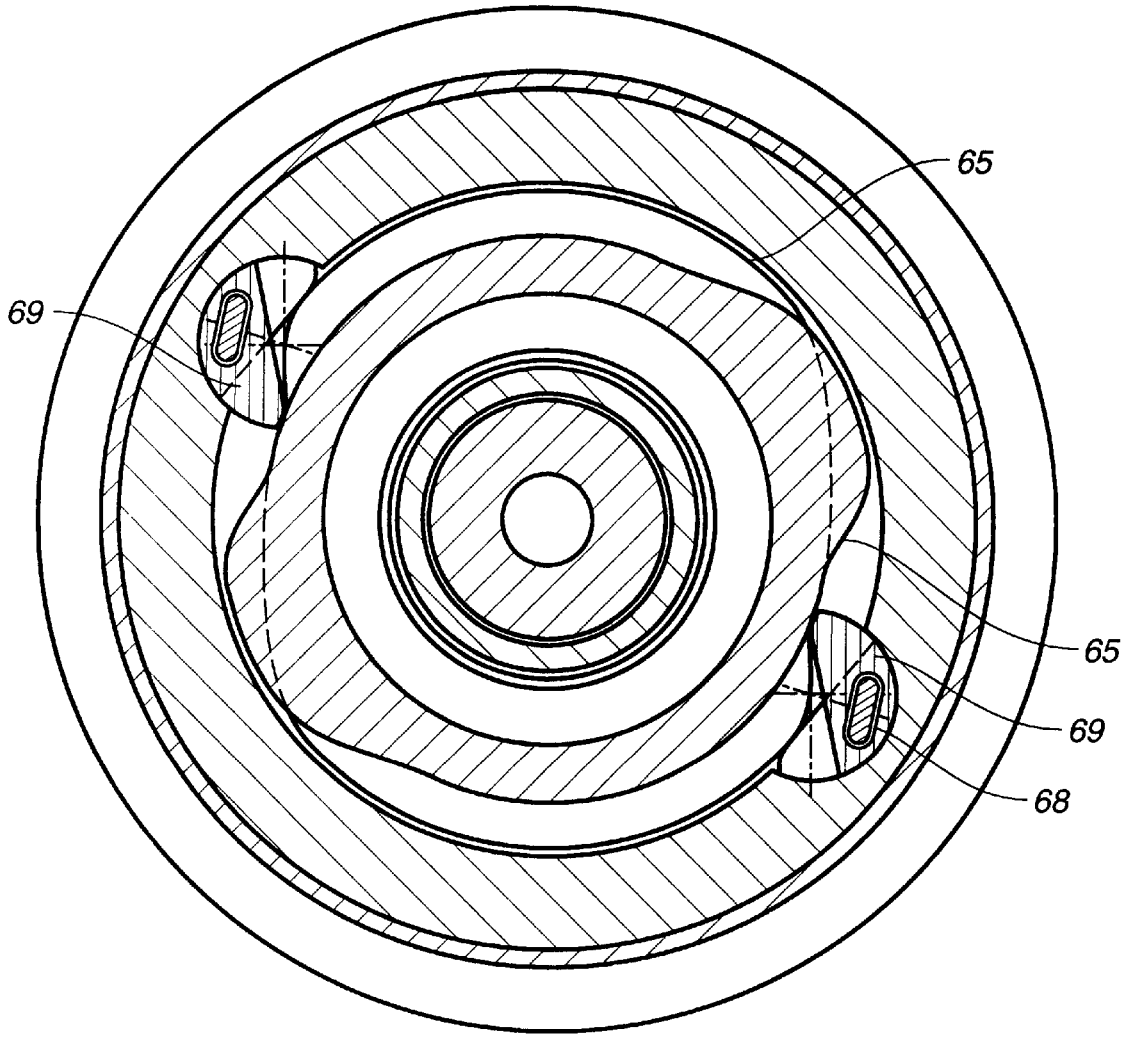
Figure 60:
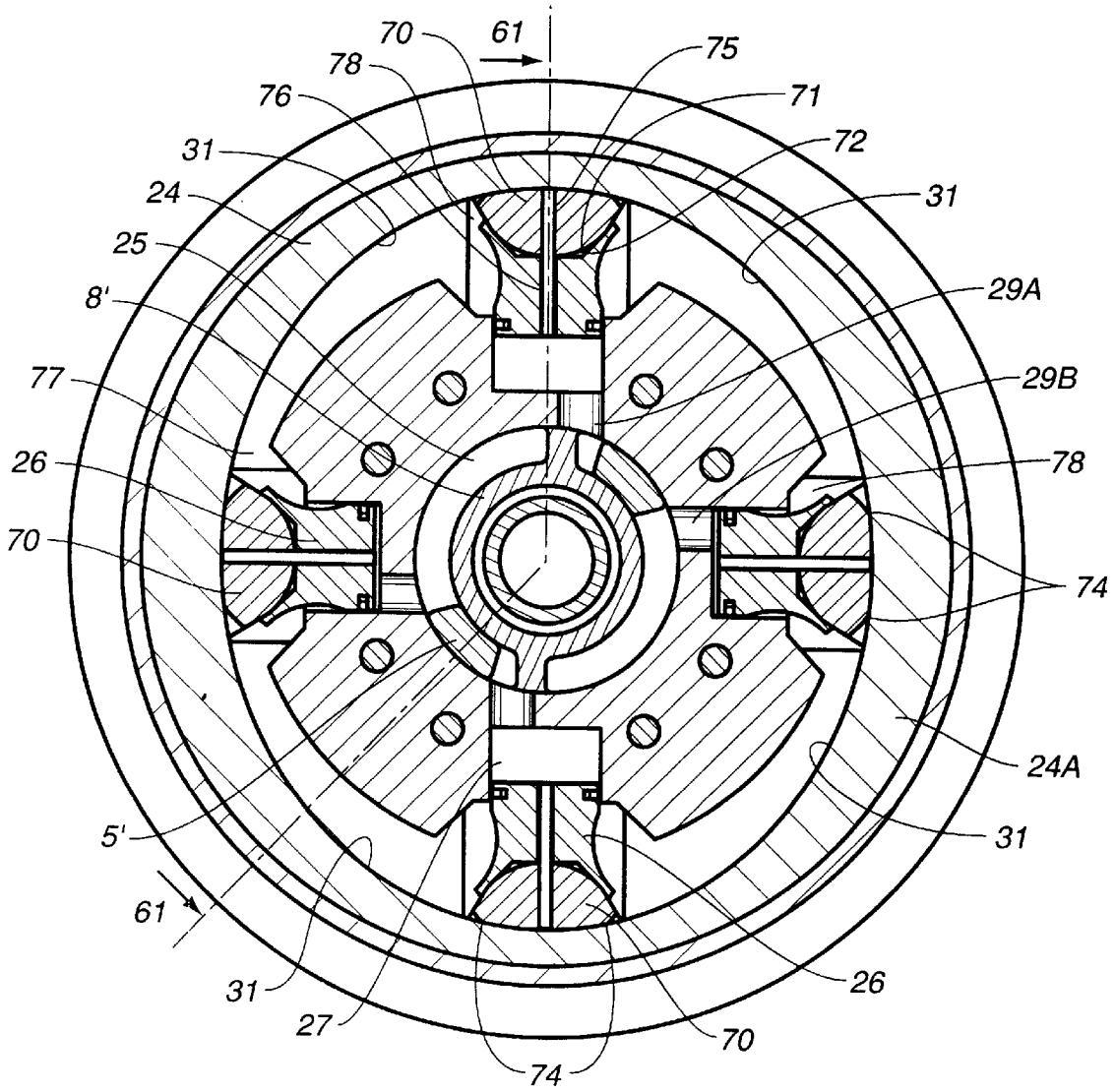
Figure 61:
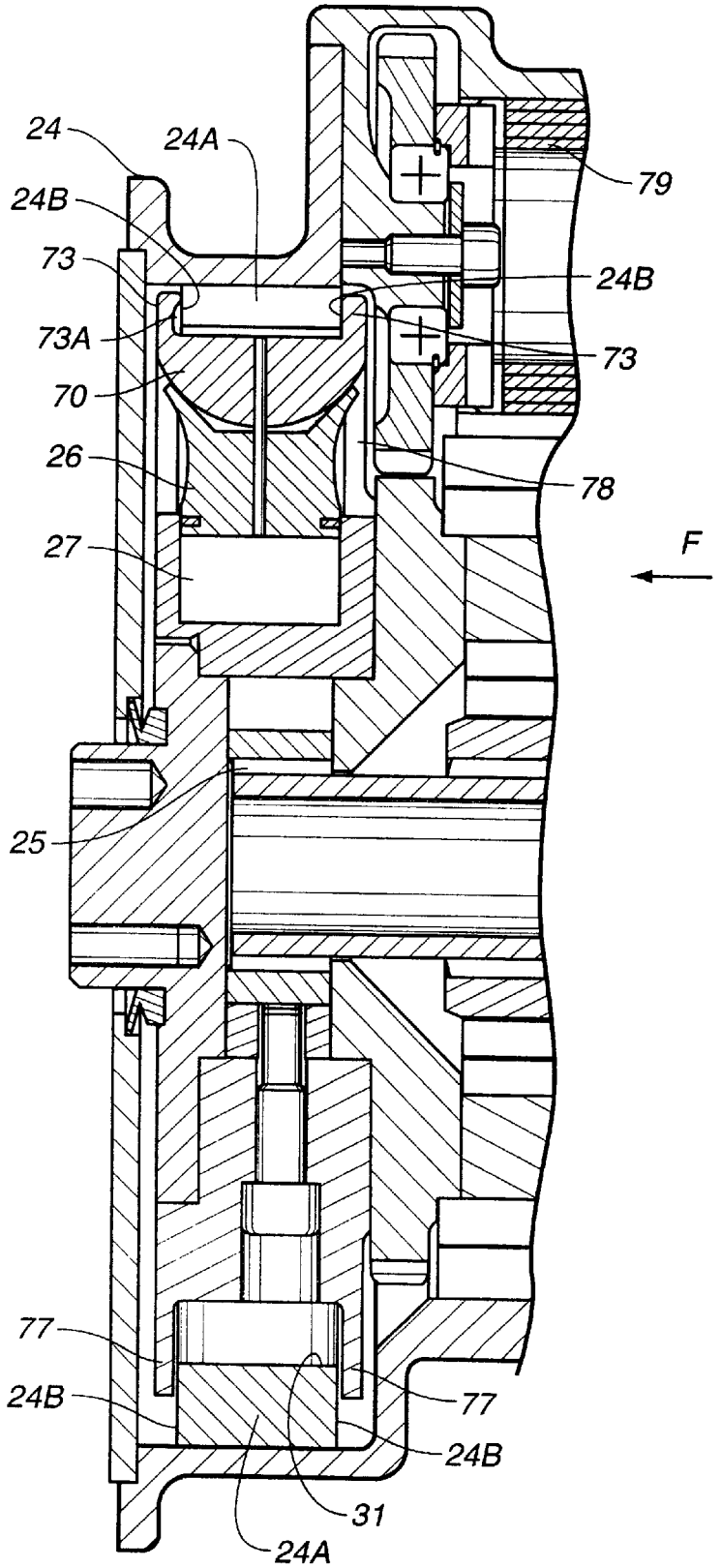
Figure 62:
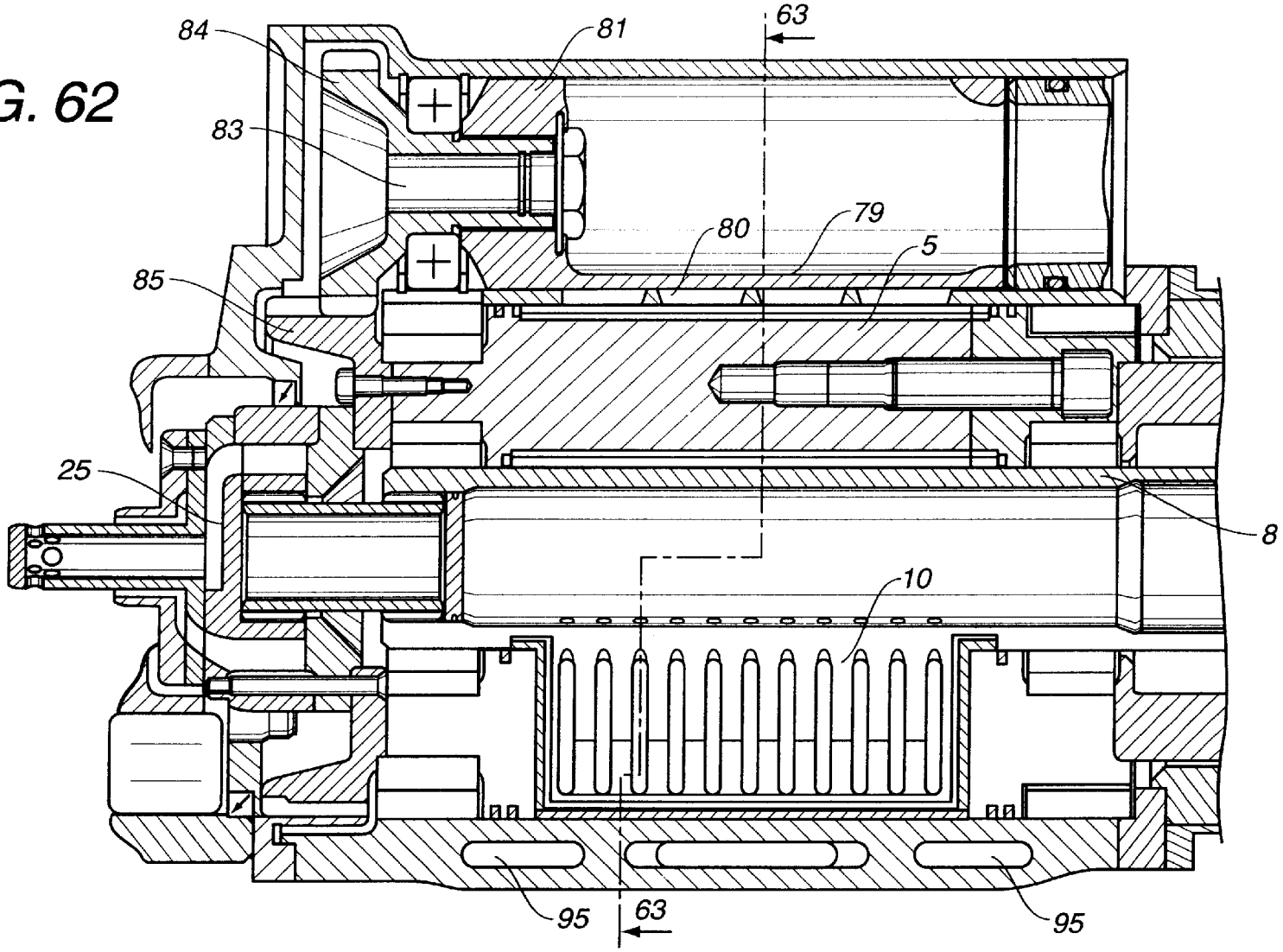
Figure 63:
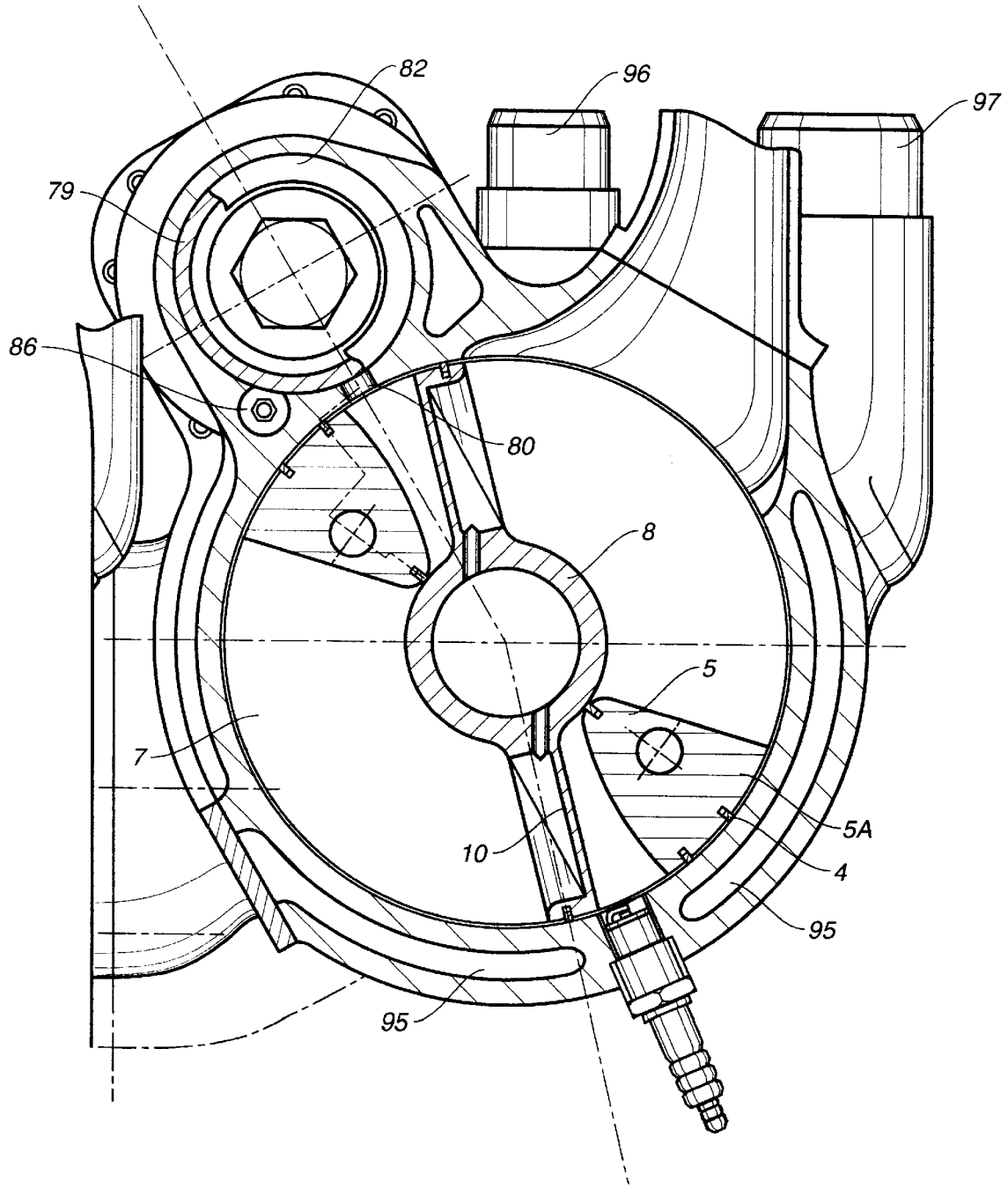
Figure 64:
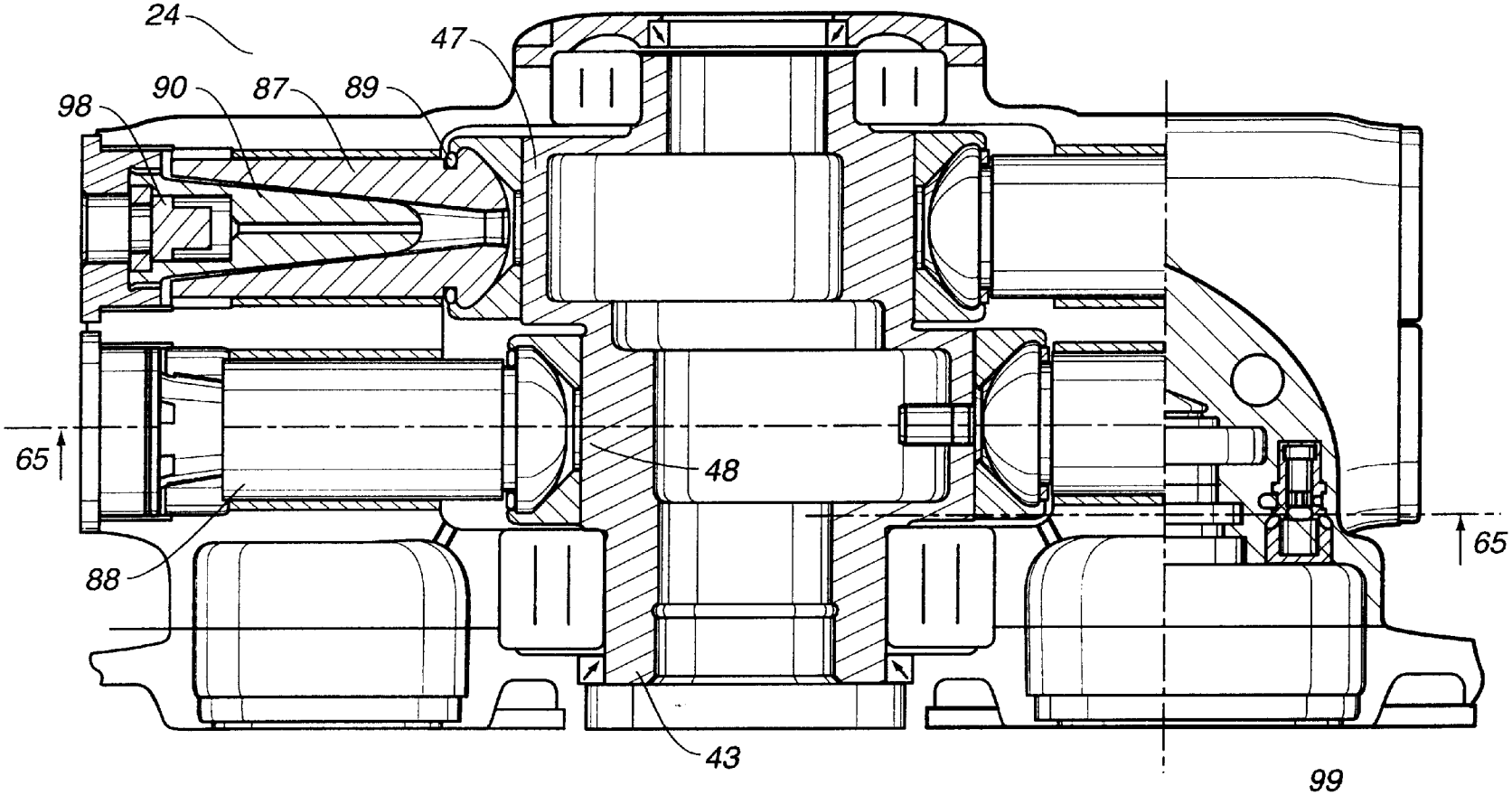
Figure 65:
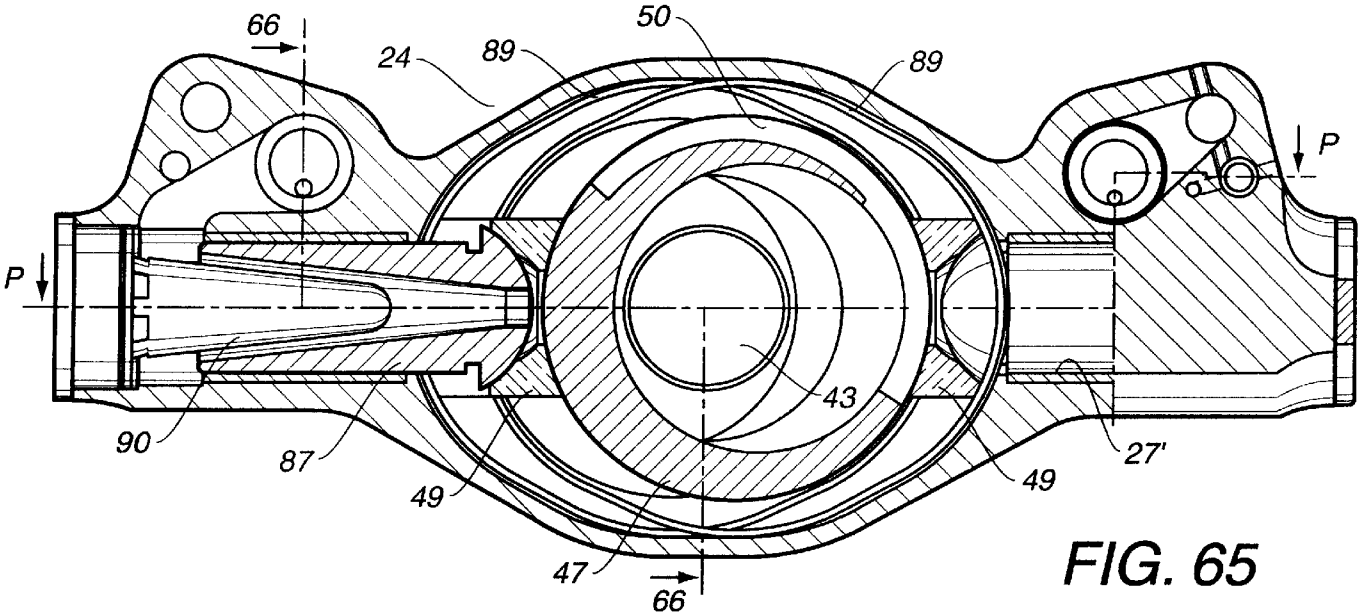
Figure 67:
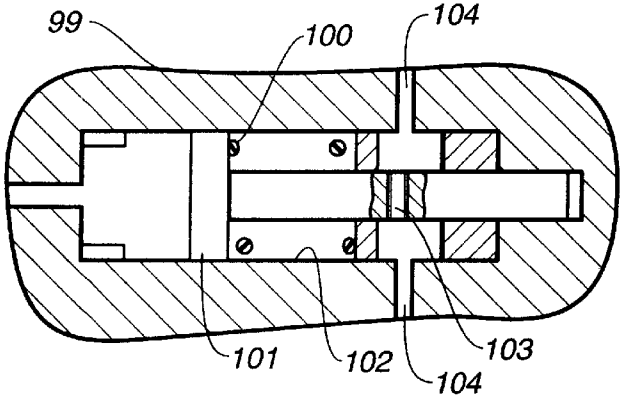
Figure 66:
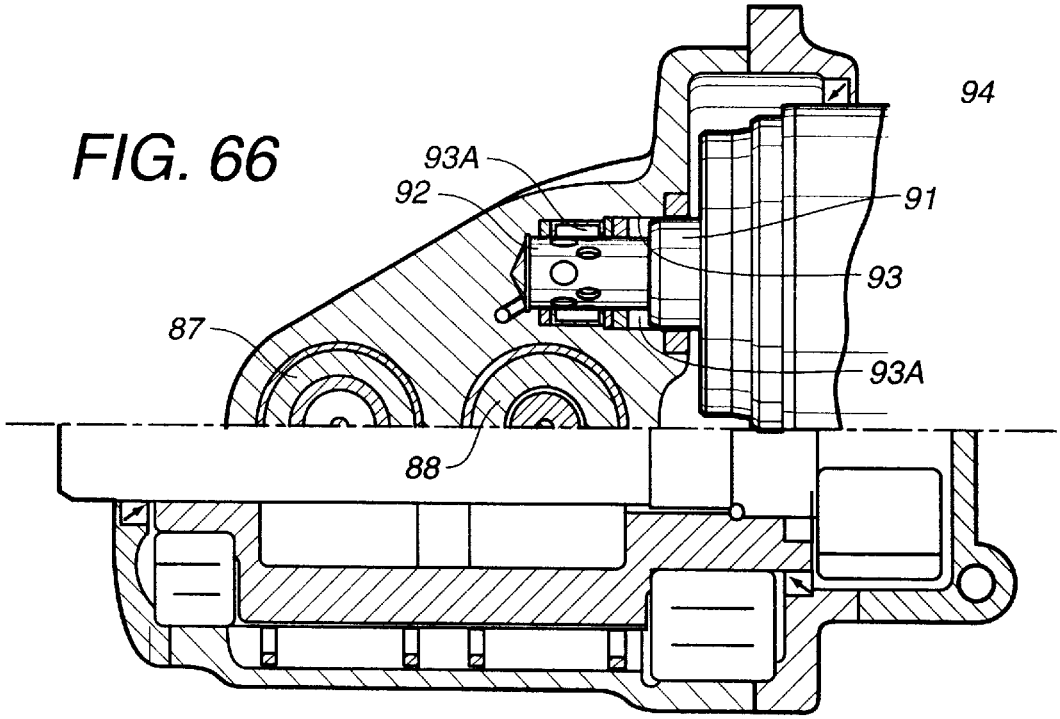
Figure 68:
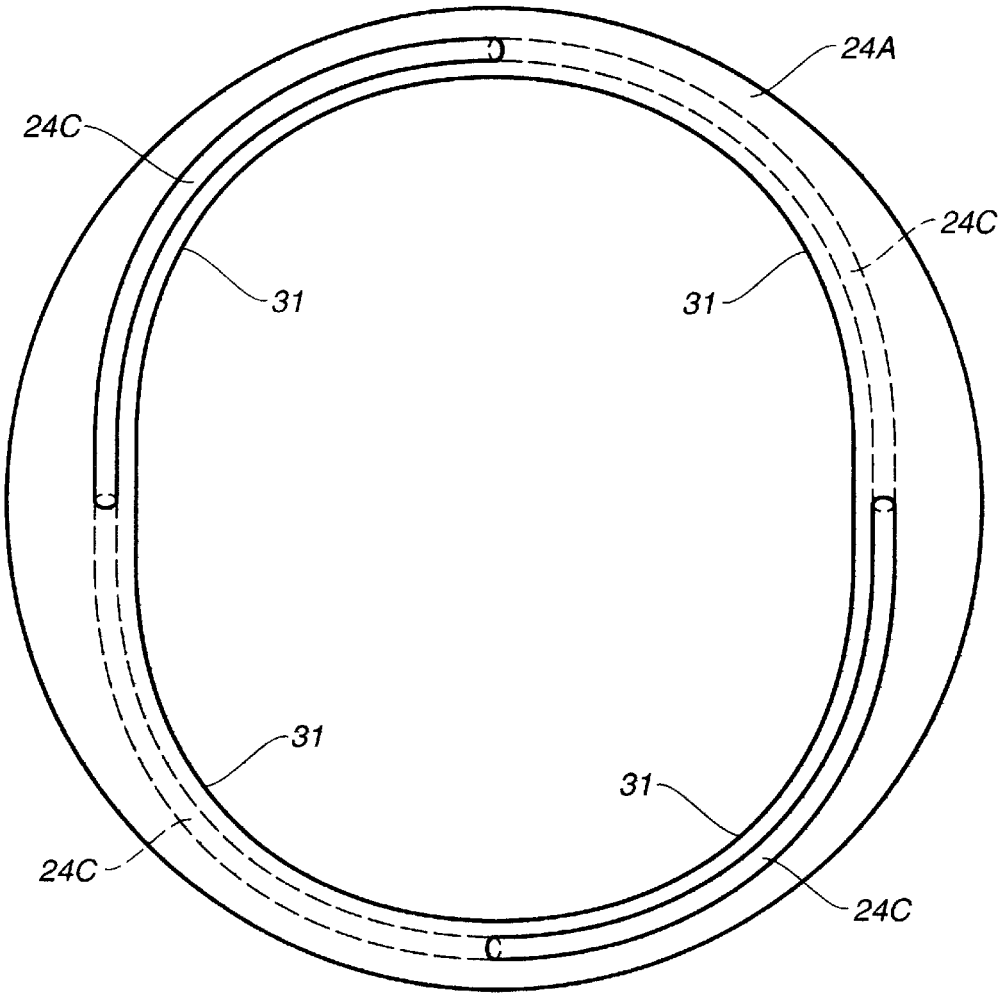

FIG. 14 a partial longitudinal cross-sectional view of a hydraulic motor;

FIG. 15 is a schematic view of an engine comprising a plurality of engine units distributed around a central driving shaft;

FIG. 16 is a longitudinal partial cross-sectional view of the engine according to FIG. 15;

FIG. 17 is a cross-section along the line 17—17 of FIGS. 16;

FIG. 18 is a cross-sectional view along the line 18—18 of FIG. 16;

FIG. 19 is a partial cross-sectional view along the line 19—19 of FIG. 18;

FIGS. 20–25 show the engine intake phase according to FIG. 1;

FIGS. 26–31 show the engine compression and ignition phase according to FIG. 1;

FIGS. 32–36 show the explosion phase, and the beginning of the exhaust of the engine according to FIG. 1;

FIGS. 37–42 show the engine exhaust phase according to FIG. 1;

FIGS. 43–48 show the explosion phase taking place in the first capsuling and the intake phase taking place in the second for the engine according to FIG. 2;

FIGS. 49–54 show the exhaust phase taking place in the first capsuling and the compression phase taking place in the second for the engine according to FIG. 2;

FIG. 55 is a longitudinal cross-sectional view of a non-return mechanism according to a third embodiment;

FIG. 56 is a cross-sectional view, on a reduced scale, along the line 56—56 of FIG. 55;

FIG. 57 is a longitudinal cross-sectional view of a fourth embodiment of a non-return mechanism;

FIG. 58 is a cross-sectional view, on a reduced scale, along the line 58—58 of FIG. 57;

FIG. 59 is a cross-sectional view, on a reduced scale, along the line 59—59 of FIG. 57;

FIG. 60 is a cross-sectional view of a pump and hydraulic motor assembly according to another embodiment;

FIG. 61 is a cross-sectional view along the line 61—61 of FIG. 60;

FIG. 62 is a longitudinal cross-sectional view of a variation of the engine according the second embodiment;

FIG. 63 is a cross-sectional view along the line 63—63 of FIG. 62;

FIG. 64 is a cross-sectional view of a pump according to another embodiment;

FIG. 65 is a cross-section along the line 65—65 of FIG. 64;

FIG. 66 is a cross-section along the line 66—66 of FIG. 65;

FIG. 67 is a schematic view of a valve that is pilot operated and calibrated for the discharging of the hydraulic circuits;

FIG. 68 is a view of a ring along the arrow F of FIG. 60.

The rotary piston machine according to invention, as shown, usable particularly as a thermal engine of the internal combustion type, for example, or of the diesel type, comprises at least one engine unit 1 wherein a cylindrical chamber 2 is bored, in which two bearings 3, mounted at a distance from one another, are adapted to support a hollow rotor 5 constituting the engine power output shaft.

Figure 3:
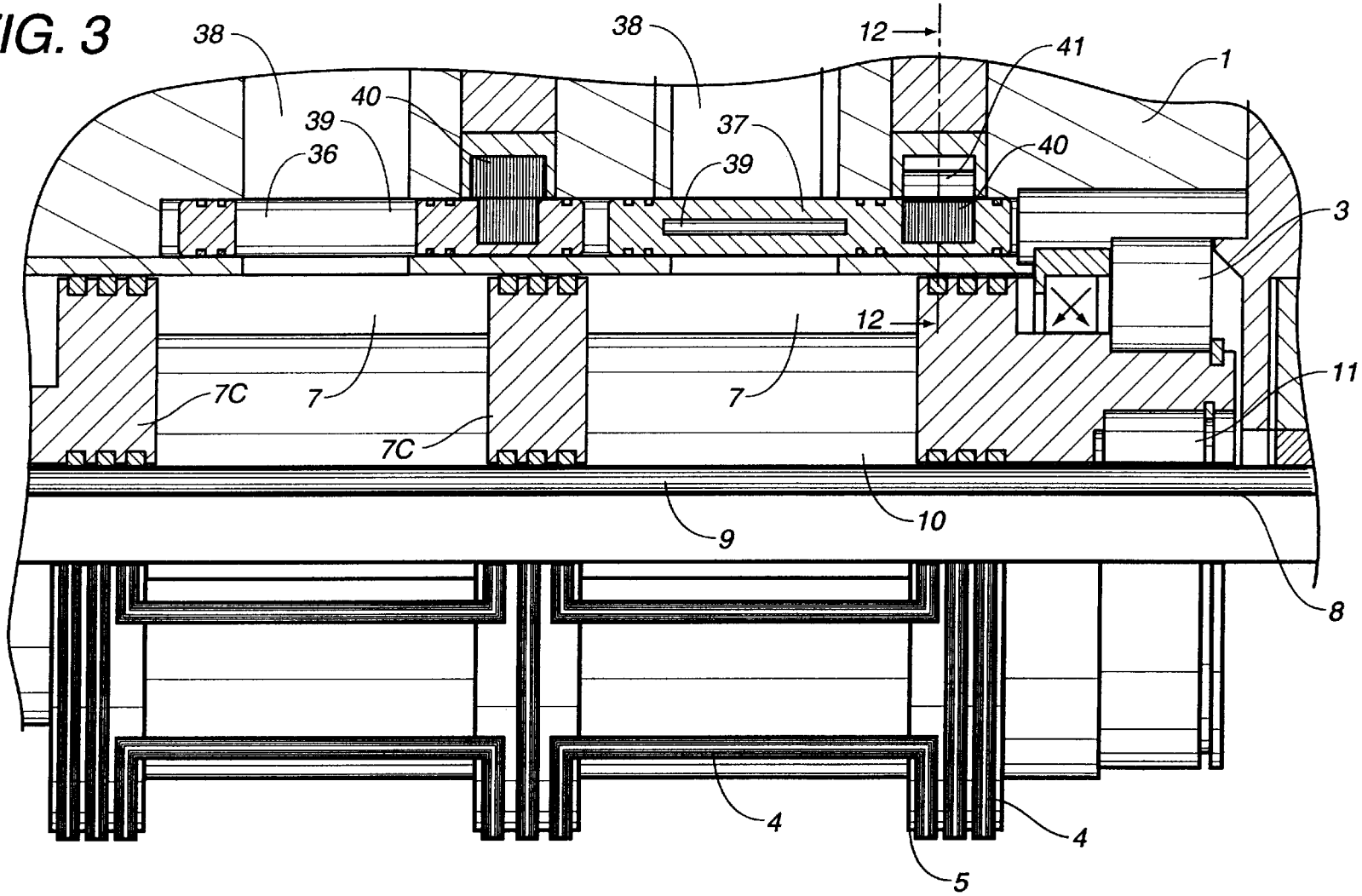
FIG. 3 is a partial longitudinal cross-sectional view of the engine according to the invention.

A sealing barrier constituted by a lip joint (FIG. 3), for example, is arranged at the level of each bearing 3, between the body 1 and the rotor 5.

The generally cylindrical hollow rotor (5) is crossed right through along its longitudinal axis by a cylindrical bore 6.

The rotor 5 comprises at least one recess 7 radially to the bore 6. This recess assumes the contour of a circular ring sector, along a section perpendicular to the axis of the rotor 5. The recess 7 has a rectangular or square cross section along a section containing the longitudinal axis of the rotor.

As can be seen in FIGS. 1, 2, 3, and 63, the recess 7 opens in the bore 6 and is demarcated by said bore, through two surfaces 7A, 7B which can be planar (FIGS. 1, 2, 3) or non-planar (FIG. 63), angularly spaced from one another and each arranged in a geometrical plane parallel to the longitudinal axis of the rotor. The recess is further demarcated by two lateral planar surfaces 7C each arranged according to a plane perpendicular to the longitudinal axis of the rotor 5.

By way of example merely provided as a guide, the surfaces 7A and 7B are angularly separated from one another by means an arc of a circumference whose value is greater than 110°. Preferably, the engine comprises at least two diametrically opposing working chambers and, to this end, at least two diametrically opposing recesses 7 are provided in the rotor 5, these recesses being angularly separated from one another by two solid portions 5A of the rotor 5 which have a cross section in the shape of a circular ring sector. The solid portions 5A each constitute a piston.

The rotor 5 has, on its external cylindrical surface, one or more projecting seal beads 4 that can be continuous, arranged about the opening of each recess 7.

These external seal beads 4 form a continuous sealing barrier around the opening of each recess 7 and are housed in grooves provided around the openings of these recesses. These continuous seal beads are formed, for example, by known sealing segments, joined together to form a single piece. These seal beads 4, as described, are subject to come into contact with the cylindrical surface of the chamber 2.

In the rotor 5, as previously described, a second rotor 8 is rotationally mounted, constituted by a shaft 9 rotationally engaged into the bore 6 of the first rotor and by at least one piston 10 radially fixed to said shaft 9 and engaged into the recess 7.

Through the shaft 9, the rotor 8 is supported by two bearings 11 each mounted at a distance from one another in a housing coaxial to the bore 6 of the rotor 5. Seal beads that can be of the type of those described previously are arranged between the bore 6 of the rotor 5 and the shaft 9 of the rotor 8, especially around the openings of the recesses 7, in order to form a continuous sealing barrier at this level.

The rotor 8 preferably comprises at least two diametrically opposing pistons 10 housed in the two recesses 7, respectively. Each piston 10 comprises, in its periphery, a sealing segment subject to come against the cylindrical surface of the chamber 2, on the one hand, and against the surfaces 7C of the recess 7, on the other hand, this sealing segment preferably assuming the contour of a "U".

The two pistons 10 are rooted in a same body extending diametrically through the shaft 9 of the second rotor 8 and form a single piece with the body, as can be seen more particularly in FIGS. 1 and 2. In FIG. 63, one can see that the pistons 10 are rooted directly in the shaft 9.

Each piston 10 forms two working chambers with the cylindrical chamber 2 and with the corresponding recess 7, i.e., with the lateral surfaces 7C, the surface 7A of one of the pistons 5A and the surface 7B of the other piston 5A.

According to the preferred embodiment of the invention, only one of these two working chambers is used to enable the gas mixture to prevail according to the thermodynamic cycle, but in a variation, one could provide the use of these two working chambers. In the annexed Figures, it is noted that the working chamber used is that demarcated particularly by the piston 10 and by the surface 7A of the corresponding piston 5A.

During each of the four phases of the thermodynamic cycle, namely, intake, compression, ignition-explosion or combustion-explosion, exhaust, the rotor 5 constituting the power output shaft accomplishes about a quarter revolution. During the intake phase of the gas mixture in each capsuling and the explosion phase of the gases in the latter (FIGS. 20–25, 32–36, 43–48), the rotor 8 is subject, by a non-return mechanism to remain angularly fixed with respect to the engine unit, at least in the reverse direction, whereas during each of the compression phase of the gas mixture and the exhaust phase of the exhaust gases (FIGS. 26–31, 37–42, 49–54), it is subject by a movement transmission means to accomplish about half a revolution with respect to the engine unit. During these two phases, the rotor 8 accomplishes about a quarter revolution with respect to the rotor 5.

The rotor 8 can occupy two distinct and diametrically opposing stop positions one of which coincides with that which it occupies during the explosion phase, and the other coincides with that which it occupies during the intake phase. The non-return mechanism is intended to oppose the reverse movement which the rotor 8 could perform, particularly under the effect of the torque induced by the thrust forces which are exerted on at least one of the pistons 10 during the gas expansion phase.

This non-return mechanism comprises a first element 12 mounted in a housing coaxial with the chamber 2 and fixed to the engine unit 1, and a second element 13 engaged with the rotor 8 and mounted in the first, one of the two elements being a ratchet wheel comprising at least two diametrically opposed teeth 14 that define the two stop positions of the rotor 8. The other element comprises two diametrically opposed radial pins 15 each movably mounted in a bore from a set-back or retraction position towards an exiting position along which each of them engages into the corresponding tooth 14 so as to ensure an angular blockage of the rotor 8 along a direction contrary to the direction of rotation of the rotor 5.

Preferably, the pins 15 form pistons in their bore and are mobilized towards their position for exiting and engaging their tooth 14 by a spring and/or by the hydraulic pressure delivered by a hydraulic pressure source.

Figure 5:
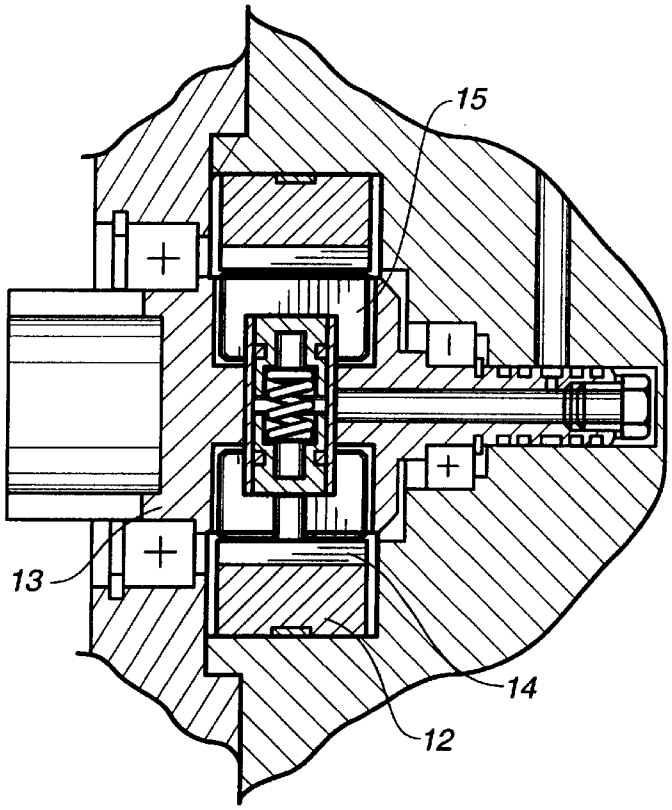
FIG. 5 is a longitudinal cross-sectional view along the line 5—5 of FIG. 4.
Figure 4:
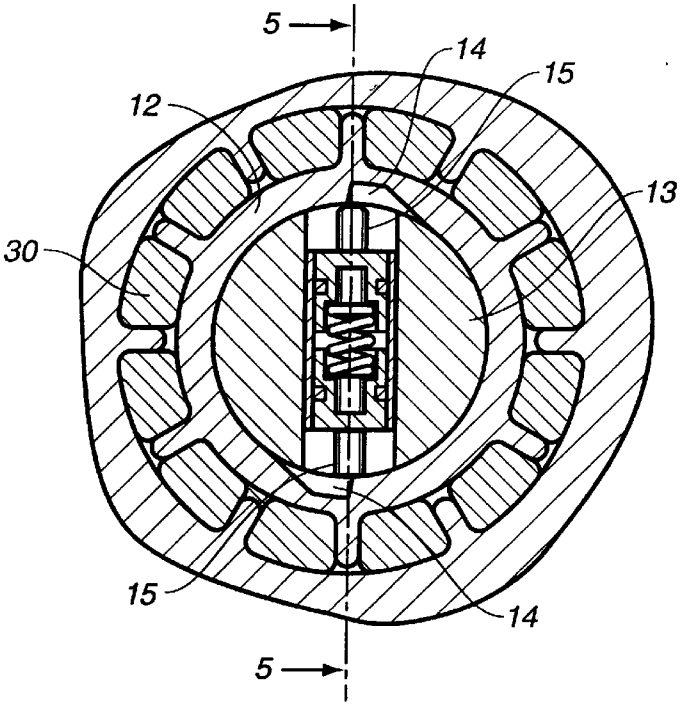
FIG. 4 is a transverse cross-sectional view of a non-return mechanism according to a first embodiment.

In FIGS. 4 and 5, a non-return mechanism is shown which comprises an external ratchet wheel, the pins 15 being slidably engaged into a common bore provided in a cylindrical body affixed to the rotor 8, said bore being capable of being supplied with hydraulic pressure through an axial perforation connected to a conduit for supplying pressurized hydraulic fluid by means of a rotating joint.

Figure 7:
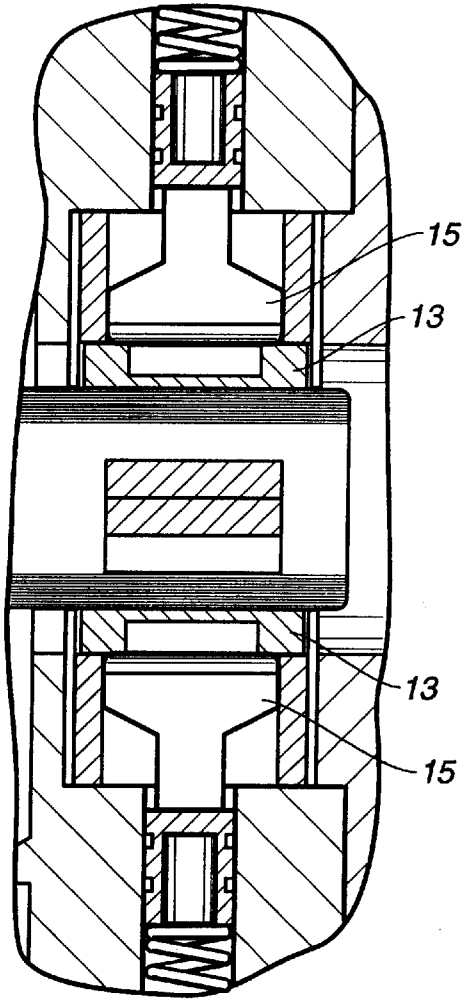
FIG. 7 is a longitudinal cross-sectional view along the line 7—7 of FIG. 6.
Figure 6:
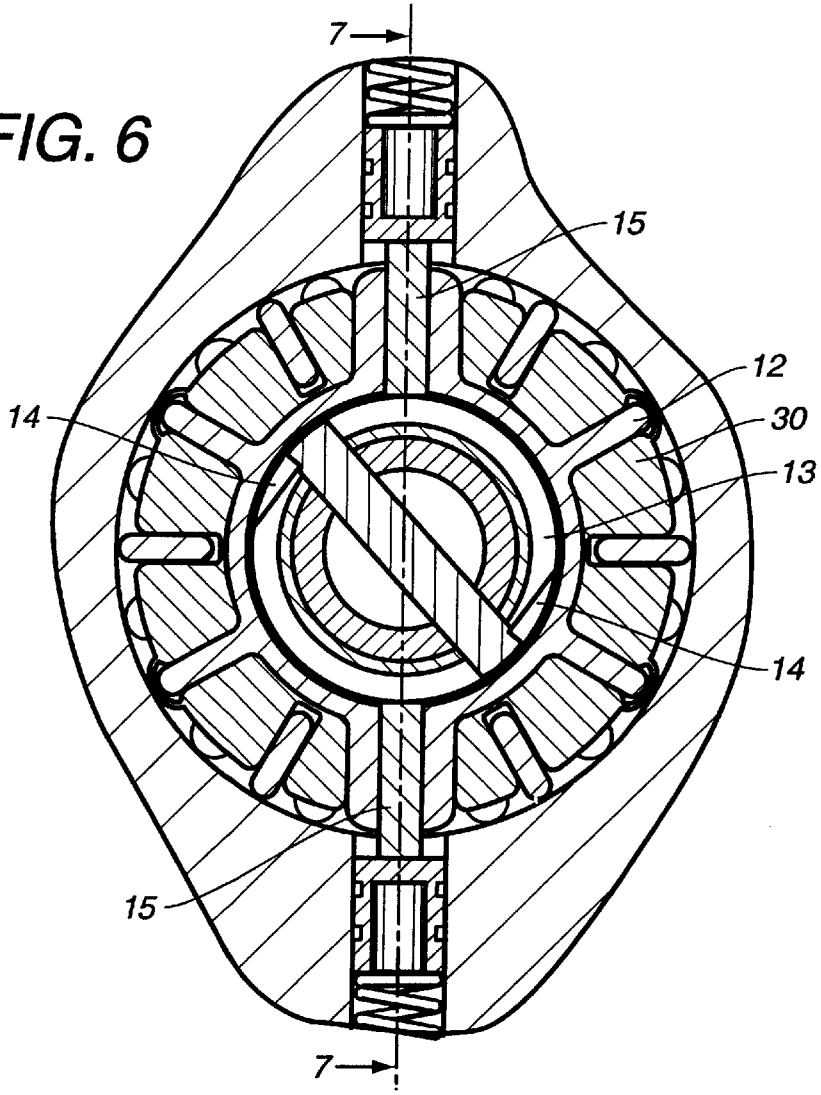
FIG. 6 is a transverse cross-sectional view of a non-return mechanism according to a second embodiment.

According to another embodiment, such as shown in FIGS. 6 and 7, the ratchet wheel is affixed to the rotor 8, the two pins 15 being mounted in two opposed bores aligned with one another along a same diameter. According to this embodiment, the two bores can be connected to a same pressure source. Each pin 15 of either embodiment can be associated with a resilient member such as a coil compression spring mounted in the corresponding bore. This resilient member applies a thrust action on the corresponding pin 15 towards its exiting position.

The first element 12 of the non-return mechanism is fixed to the engine unit by means of a system 30 for absorbing and dissipating the mechanical shocks. This system is constituted, for example, by a plurality of shock absorbing elements uniformly distributed in the annular interval between the first element 12 and the engine unit, in deformable cells each demarcated by two radial walls extending in the annular interval of which one is fixed to the first element and the other is fixed to the engine unit.

The source of hydraulic pressure for activating the pistons 15 towards their position of engagement into the teeth 14 can be constituted by a hydraulic actuator 16 having an off-centered rotor and two movable blades 17.

The blades 17 divides the inner volume of the stator of the hydraulic actuator into one front chamber 18 and one rear chamber 19 connected to one another through a non-return valve 20.

An annular groove 21 is machined in the surface of the stator, each blade 17 being subject to slide, through one of its ends, to slide on the edges of such groove.

The cylindrical housing comprises two diametrically opposed sealing segments 22 in the groove 21, the angular position of the sealing segments 22 coinciding with the two stop positions of the rotor 8. The blades 17 are slidably mounted in a diametral housing of the rotor of the hydraulic actuator. The two chambers 18 and 19 communicate with one another through the groove 21 when the blades 17 are angularly offset with respect to the sealing elements 22. On the other hand, when the blades are aligned with the sealing segments 22, the front 18 and rear 19 chambers communicate with one another only by means of the non-return valve 20 which prevents any oil back flow from the rear chamber 19 towards the front chamber 18.

Figure 8:
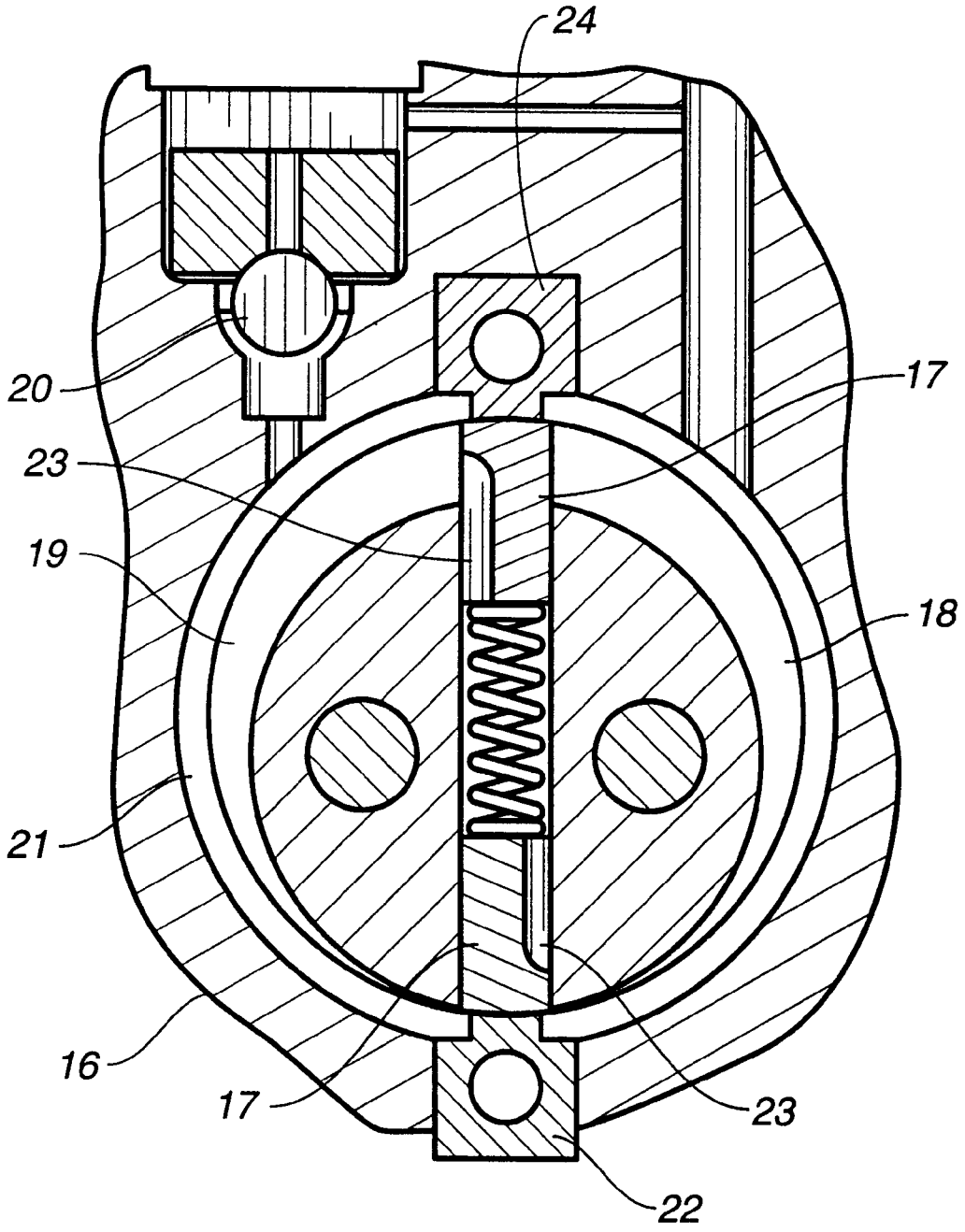
FIG. 8 shows in a transverse cross-section a hydraulic actuator capable of being associated with the non-return mechanism.

A slight reverse movement of the rotor 8 drives the rotor of the actuator in the same direction, which creates an excessive pressure in the rear chamber 19 of the actuator 16, and this excessive pressure is used to activate the radial pins 15 in the direction of engagement in the teeth 14 of the ratchet wheel. To this end, the rear chamber 19 of the actuator 16 is in communication with the bore(s) of the radial pins 15. According to the preferred embodiment of the invention, to ensure this communication, each blade 17, from its end that is the closest to the center of the rotor, is provided with a groove 23 extending radially with respect to the off-centered rotor of the actuator 16, this radial groove creating a passage towards the diametral housing of the off-centered rotor only when the blade occupies an exiting position with respect to this housing. This blade 17 occupies this position when its groove 23 is in communication with the rear chamber 19. As can be seen in FIG. 8, the groove is not provided along the entire length of the blade and its farthest end from the center of the rotor remains distanced from the corresponding end of the blade, such that when the latter is totally set back in the diametral housing, the farthest end from the center of the rotor blocks the corresponding end of said housing.

The diametral housing of the off-centered rotor is in communication with the bore(s) for guiding the pins 15 by means of a perforation and/or a rotating joint.

A non-return mechanism has been previously described, whose elements 12 and 13 cooperate with one another in an angular blocking by penetration of the pins 15 in the teeth 14. According to two alternative embodiments, as shown in FIGS. 55, 56, and 57–59, respectively, the first element 12 affixed to the engine unit and the second element 13 affixed to the intermittently operating rotor 8 form at least one cell 55 in which, during the explosion and intake phases, a volume of oil is confined to prevent at least the reverse rotation of the second element 13.

As can be seen in FIGS. 55–59, the first element 12 comprises a chamber 56 in which the second element 13 is mounted. This chamber accepts the geometrical axis of rotation of the rotors 5 and 8 as an axis of symmetry. This chamber is demarcated by two front 57 and rear 58 walls spaced apart and each extending perpendicularly to the axis of symmetry, and by a casing wall 59 arranged between the front and rear walls. The second element 13 of the non-return mechanism is constituted by a central core 13A coupled to the rotor 8 and by two blades 60 extending radially from this core, in a diametrically opposite manner.

The core 13A of the second element is prolonged axially by a channeled shaft adapted to be coupled outside the chamber 56 to a channeled sleeve provided at the end of the rotor 8. The channeled shaft crosses the front wall 57 right through by engaging in a bore provided in the latter. At the level of the bore, the shaft is smooth so as to cooperate with a sealed guide bearing mounted in the bore. Opposite the channeled shaft, the central core 13A of the second element is prolonged axially by a second shaft engaged in a second guide bearing mounted in a bore provided in the rear wall 58. The surface 59A inside the chamber 56 of the casing wall 59 comprises two diametrically opposed surface sectors 61 with respect to the axis of rotation of the second element 13 against which the ends of the radial blades 60 are pressed when the two elements of the non-return mechanism are in a relation of angular blockage with respect to one another. One of the two elements of the non-return mechanism carries, in the chamber, two sealing members 62 each preferably constituted by a flap and the other element of the non-return mechanism is provided, in the chamber, with two diametrically opposed surface sectors 63 with respect to the axis of rotation of the second element against which the sealing members 62 are pressed when the two elements 12 and 13 are in a relation of angular blockage with respect to one another. As can be seen in FIGS. 56 and 58, the surface sectors 63 are closer to the axis of rotation of the second element than the surface sectors 61. In the position of angular blocking of the two elements 12, 13, one with respect to the another, the blades 60, the sealing members 62 and the surfaces inside the chamber of the front 57 and rear 58 walls and casing wall 59 form two diametrically apposed impervious cells 55 filled with oil and separated angularly from one another by two ullages 55A also filled with oil.

Considering the reverse direction of the engine, the sealing member of each cell is located in front of the blade of this cell.

The volume of oil confined in each cell opposes the variation of the volume of the latter towards a decrease, which corresponds to the reverse direction of the movement of the second element. In this way, the second element and therefore the rotor 8 are rotationally blocked in the reverse direction.

It must be noted that the explosion phase begins before the complete stop of the intermittently driven rotor, such that at the very beginning of this phase, the rotor, in view of its inertia, performs a fraction of revolution while decelerating down to zero speed, then, under the effect of the pressure prevailing in the engine working chamber(s), is driven in the reverse direction. The second element 13 of the non-return mechanism is therefore driven by the rotor 8, first in the direction of rotation of the engine, then in the reverse up to the blocking position. It must also be noted that the cells 55 are formed at the end of the compression phase such that during the movement in the direction of rotation of the engine of the second element 13, at the end of the compression phase, and at the very beginning of the explosion phase, a vacuum is created in each cell with respect to the pressure prevailing in the ullages 55A, due to the increase in the volume of the latter. To prevent this disadvantage, a non-return valve 55D is associated with each cell which enables the oil to be introduced into said cell, this oil being in the ullage 55A.

Advantageously, a means is provided for indexing the position of angular blockage of the two elements 12, 13 with respect to one another, and therefore of the rotor 8 with respect to the engine unit, this indexing means allowing for the reverse movement of the second element 13 towards its blocking position by controlling this movement.

Preferably, the two surface sectors 61 are each provided with a leakage cross-section 64, which makes it possible to obtain the indexing of the position of angular blockage of the two elements 12, 13 with respect to one another. As long as the corresponding blade 60 is at its level, this leakage cross-section 64 allows for a slight reverse movement of the second element 13 which will be blocked angularly as soon as the blade will have passed through the leakage cross-section 64.

In a strict sense, the angular stop position is slightly variable and is dependent upon a number of parameters among which one can cite the internal oil leakages at the level of the cells which themselves depend upon the engine speed and the load. This stop position fluctuates around an original position as a function of the above-mentioned parameters.

In the embodiment shown in FIGS. 55 and 56, the blades 60 are each slidably mounted in a groove 13B provided radially in the core 13A of the second element 13, and are pressed against the internal surface 59A of the casing wall 59 by at least one resilient member 60B. In the embodiment shown in FIGS. 55 and 56, the two grooves 13B of the core 13A are diametrically opposed, and the core 13A, from the bottom of one of the two grooves to the bottom of the other is crossed right through by a cylindrical bore 13C in which a cylindrical finger 60A which the blade 60 comprises is engaged with a sliding fit. The resilient member 60B is compressed in the radial bore 13C between the finger 60A of one of the blades and the finger 60A of the other, this resilient member being constituted by a coil spring.

Advantageously, these two fingers 60A are each provided with a blind axial perforation in which the return resilient member 60B engages.

Preferably, a plurality of bores 13C are provided, and each blade is provided with a plurality of fingers 60A. A plurality of resilient members 602 are also provided, each of which comes to be positioned in a bore, in compression between the finger of one of the blades and the finger of the other.

The core 13A of the second element carries the two sealing members 62 which occupy a stationary position with respect to the latter, and are angularly distanced from the blades 60. According to this embodiment, the surface sectors 63 are formed in the surface 59A of the casing wall 59, with an angular spacing from the surface sectors 61, and said chamber assumes a substantially oval contour. Each sealing member 62, according to this embodiment, forms a projection on the core and is maintained in a stationary angular position with respect to the latter against a stop surface for the core by a resilient member such as a leaf spring.

It must be noted that the surface sectors 61 and 63 can be part of cylindrical surfaces.

A plurality of channels 55B provided in the front wall 57 lead to in each cell 55 formed during the angular blocking of the two elements 12, 13, with respect to one another. Each of these channels further leads to the end of a blind bore provided in this wall. A cylindrical buffer 55C for support against the engine unit is slidably mounted in the blind bore. The front wall 57 is mounted with a possibility of limited axial displacement. When the two elements 12, 13 are in a blocking relationship, the oil confined in each cell 55 is pressurized and is introduced under pressure through the channel 55B into the gap between the end of the bore and the support buffer 55C. The latter is then pressed against the engine unit and, by reaction, the wall 57 is applied against the core 13A thus limiting the operational backlash and, therefore, the internal oil leakages at the level of the lateral side of the blades 60 and of the sealing members 62. As the coupling of the second element 13 to the rotor 8 allows it the possibility of displacing axially, the action that it withstands from the front wall 57 forces its core 13A to press against the rear wall 58. In this manner, during the angular blocking, the functional backlashes are eliminated, the oil leakages limited and the sealing ensured.

In the embodiment shown in FIGS. 57–59, the blades of the second element 13 are fixed with respect to the core 13A of the latter, and the surface sectors 61 and 63 belong respectively to cylindrical surfaces. The sectors 63 are arranged on the core 13A with angular spacing of the blades 60. The cylindrical surface carrying the cylindrical sectors 61 has a greater diameter than the cylindrical surface carrying the sectors 63.

Furthermore, according to this embodiment, the sealing members 62 are fixed in a journalled manner to the first element 12 and are driven in their pivoting movement towards the core 13A of the first element 13 or away therefrom by at least one cam 65 coupled to the continuously driven rotor 5, or as a variation, to the intermittently driven rotor. As can be seen in FIG. 58, the cylindrical surface sectors 61 are both formed in two excessive thicknesses, respectively, of the cylindrical envelope, these two excessive thicknesses being diametrically opposed.

Each flap 62 comprises a base 66 provided with retention pins 67 engaged in two perforations provided opposite one another in the front wall 57 and in the rear wall 58, along the pivoting axis of the flap. An arm 68 in the form of a torsion spring is fixed to the base 66, at the end of which arm is mounted a finger 69 coming into a sliding support on the cam surface 65 which is preferably provided in a sleeve coupled to the rotor 5 and arranged at the front of the front wall 57.

As can be seen in FIGS. 57 and 59, two cams 65 arranged side by side are provided, and two fingers 69 cooperating respectively in a sliding support with the two cam surfaces are mounted at the end of the tension spring of each flap. These two cams 65 alternatively drive and control the rocking movement of the associated flap 62.

As an alternative, one can provide a came surface coupled to the intermittent driven rotor. Therefore, this cam surface can be provided on the second element 13 of the non-return mechanism, and the flap 62 will cooperate in a sliding support with the cam surface. It can be maintained in support against this surface by a return elastic element that can be constituted by a torsion spring fixed to its base, on the one hand, and to one of the front 57 and rear 58 walls of the chamber 56, on the other hand.

The base of the flap 62 has a guiding convex surface in the form of a cylindrical surface sector whose axis is that of pivoting of the flap. This cylindrical surface sector is subject to slide during the pivoting of the flap against a concave surface in a cylindrical sector provided in the surface 59A of the casing wall 59, laterally to one of the excessive thicknesses. A ribbed bulging is rooted in the base 66 of the flap, which bulging carries, at a distance from the base 66, a flap head 62A which, in the blocking position of the two elements 12, 13 with respect of one another, is positioned in contact with one of the cylindrical surface sectors 63 of the second element 13 and extends between this second element 13 and the surface 59A of the casing wall 59.

As can be seen in FIG. 58, the head 62A of the flap 52 has a head surface in the form of a cylindrical surface sector whose axis of revolution is merged with the pivoting axis of the flap 62. The flap 62, in its pivoting movement, is guided by the convex surface of its base brought to slide against the concave surface of the casing wall lateral to one of the excessive thicknesses, on the one hand, and by the head surface brought to slide on a sealing segment mounted in a groove provided in the other excessive thickness, on the other hand.

Preferably, each flap 62 is crossed right through by a channel, from the head surface to the base. As can be seen in FIG. 58, when the head and the blade form the cell 55, this channel is in relation with said cell, such that the pressurized oil arrives between the base of the flap and the surface 59A of the casing wall 59. This arrangement ensures the hydrostatic equilibrium of the flap 62.

During the compression phase and the exhaust phase, the second element 13 is rotationally driven, and each flap 62 is distanced from the core 13A of the second element 13 and from the path of the blades 60 by means of a cooperation of the cams 65, the fingers 69, and of the arm 68. To ensure the angular blocking of the second element 13 during the intake and explosion phases, the flaps 62 are brought back against the core of the second element 13. To balance the pressures in the cells 55, the latter can be connected to one another by a balancing channel provided in the core 13A.

Finally, it must be noted that the non-return mechanism according to the last two embodiments is provided with an oil inlet opening in at least one of the two ullages 55A, and with an oil outlet to ensure the change and the cooling of the oil.

The means for activating the rotor 8 rotationally activates the latter during the compression and exhaust phases. It is preferably coupled to the rotor 5 and to the rotor 8, and ensures the transmission of the rotational movement. An engaging member which occupies a disengaged position during the intake and explosion phases is preferably arranged on the kinematic chain for transmitting the movement between the first rotor 5 and the second rotor 8, such that the rotational movement of the rotor 5 is no longer transmitted to the rotor 8 during these phases. During the compression and exhaust phases, the engaging member occupies an engaged position, such that the rotor 8 is activated in rotation.

This activation means is constituted by a hydraulic pump 24 coupled by means of its rotor to the rotor 5 and by means of its stator to the engine unit, as well as by a hydraulic motor 25 coupled to the rotor 8 and connected to the hydraulic pump by means of a hydraulic circuit. Preferably, the hydraulic motor is coupled to the rotor 5 by means of its stator, whereas it is coupled to the rotor 8 by means of its rotor. Thus, the stator of the hydraulic engine is rotationally driven by the rotor 5. The quantity of oil provided to the hydraulic motor 25 by the pump 24 causes a relative rotation of the second rotor 5 with respect to the first rotor 8.

It must be noted that in order to consider the compressibility and the leakages of the oil, which are dependent upon the engine speed and the load, the hydraulic pump provides the hydraulic motor with a quantity of oil slightly greater than theoretically necessary. This difference would cumulate upon each revolution of the rotor and in the absence of an indexation at the level of the non-return mechanism. This would lead to progressively offset the relative position of the intermittently operating rotor 8 with respect to the continuously operating rotor 5, up to an equilibrium position where the pressures involved lead to compressions and leakages of oil such that this difference is eliminated. Thus the compression ratio would tend to diminish when the torque increases and the speed decreases. These effects are substantially attenuated due to the indexing of the angular blocking position.

The activation means preferably comprises an engaging member constituted, for example, by a valve which, during the intake and explosion phases, partially or totally opens the hydraulic circuit between the motor and the pump, and closes it during the compression and exhaust phases.

Preferably, the hydraulic motor 25 comprises at least one rear chamber and at least one front chamber both connected to the hydraulic pump 24 by means of the hydraulic circuit. The engagement member constituted by a rotating valve, for example, is arranged on this hydraulic circuit. This rotating valve creates a hydraulic shunt, during the intake and explosion phases, by connecting the front and rear chambers of the hydraulic motor to one another, as well as the inlet and outlet of the hydraulic pump, which then discharge themselves, this hydraulic shunt being comparable to the opening of the hydraulic circuit between the pump and the engine.

The hydraulic pump 24 comprises radial pistons 26 each slidably mounted in a cylindrical chamber 27 provided radially in its rotor. The pistons each comprise at least one roller 28 subject to roll successively during the rotation of the rotor on internal came surfaces 31 provided in the stator of the pump.

According to the preferred embodiment of the invention, the pump 24 is equipped with four systems of piston 26 and cylindrical chamber 27, these systems being opposed two by two along a same diameter and being uniformly spaced from one another, the angular spacing between two consecutive systems being 90°. Each system, through its chamber 27, is hydraulically connected to the chamber 27 of the opposite system by means of at least one diametral perforation, in order to balance the pressures. Therefore, two diametrically opposed systems operate together and are both connected to one of the chambers 25 of the hydraulic motor by one or more conduits 29A. The other chamber of this hydraulic motor is connected to the other two systems by one or more hydraulic conduits 29B. These systems are functionally arranged by groups, one of the two groups being hydraulically connected to the rear chamber of the engine, and the other to the front chamber.

The stator of the pump 24 is equipped with four cam surfaces 31 positioned behind one another around the rotor. At every moment, each cam surface 31 cooperates with only one piston 26. These came surfaces are configured so as to enable, during the rotation of the rotor of the pump, the movement towards the center of the rotor of the two pistons of one of the groups of the systems, and the movement of the other two pistons of the other group towards the periphery of the rotor. As a result, there is a volume variation in the chambers 27 of the systems at every moment, the absolute values of the instantaneous volume variations being substantially equal.

Figure 13:
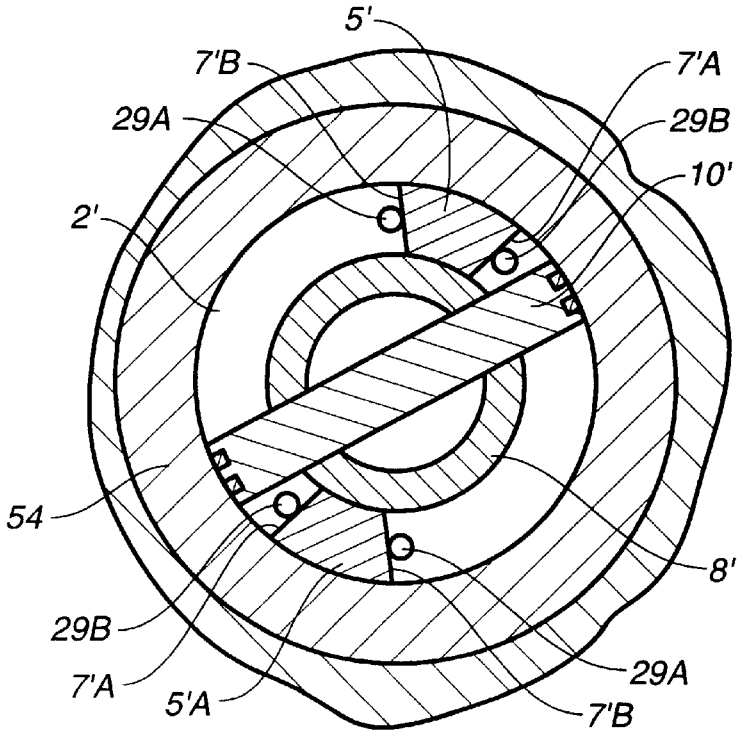
FIG. 13 is transverse cross-sectional view of a hydraulic motor.

Preferably, the hydraulic motor is structured based on the same architecture as that of the thermal engine described previously. Thus, the hydraulic motor 25 (FIGS. 13, 14 and 60) is constituted by at least two consecutive working chambers obtained by rotors 5' and 8', one of these working chambers constitute the front chamber and the other the rear chamber. The rotors 5' and 8' constituting the stator and the rotor, respectively, of the hydraulic motor, can be independent elements coupled to the rotors 5 and 8, respectively, or can be constituted by a portion of the rotors 5 and 8, respectively. The rotors 5' and 8' are mounted with an interpenetration configuration, and the rotor 5' is hollowed and comprises two recesses 7' having the same shape as the recesses 7 of the rotor 8, and two pistons 5'A having the same shape as the pistons SA of the rotor 5, said pistons 5'A having a face 7'A and a face 7'B.

The two diametrically opposed pistons 10' of the rotor 8' are displaced in the diametrically opposed recesses 7'. The rotors 5' and 8' are mounted in a cylindrical chamber 2' formed in a tubular element 54, the rotors 5', 8' and the cylindrical chamber are coaxial. The tubular element 54 is fixed to the rotor 5', the latter is force fitted in the cylindrical chamber 2' through the cylindrical surface of each of its pistons 5'A. The pistons 5'A, 10' and the cylindrical chamber form four working chambers that are diametrically opposed two by two. Advantageously, four working chambers are used, the internal volumes of two diametrically opposed working chambers will constitute the rear chamber of the hydraulic motor, the internal volumes of the other two will constitute the front chamber. The front chamber of the motor is demarcated between the faces 7'B and the pistons 10', the rear chamber between the faces 7'A and the pistons 10'. Two conduits open on both sides of each piston 5'A, one of which is supply conduit 29A and the other is the delivery conduit 29B.

The tubular element 54 can be mounted in rotating guide bearings and can be fixed to the rotor of the pump 24. It can also be integral with the rotor of the pump 24.

The hydraulic motor will be axially spaced from the thermal engine and formed in the cold portion of the engine unit.

The hydraulic motor and the thermal engine operate in phase.

During the compression and exhaust phases, the front chamber of the hydraulic motor is fed with hydraulic fluid by the hydraulic pump 24, whereas the fluid in the rear chamber of this motor is led to flow back towards the pump, which enables the rotor 8 to be driven along approximately a quarter revolution with respect to the rotor 5, the latter accomplishing about a quarter revolution during these phases, the association of these two relative motions leading the rotor 8 to accomplish about half a revolution with respect to the engine unit.

By way of example, during each of the compression and exhaust phases, the rotor 5 can accomplish a 100-degree rotation with respect to the engine unit, while the rotor 8 makes a 80-degree rotation with respect to the rotor 5.

The movement of the rotor 8 is first accelerated to a maximum speed, and is then decelerated. The feeding of the front chamber of the hydraulic motor ensures the mobilization of this rotor 8 during the acceleration phase of the rotation movement. This mobilization is controlled during the deceleration phase of the rotor 8 by the rear chamber of the hydraulic motor. The flow of oil supplied by the pump to the front chamber of the hydraulic motor during the compression phase is therefore variable, i.e., it first increases, and then decreases. The acceleration of the movement of the rotor 8 corresponds to the increasing phase of the flow rate, while the deceleration of the movement of the piston 8 corresponds to the decreasing phase, this movement being still controlled by the rear chamber of the hydraulic motor. During the compression phase, the oil in the rear chamber of the hydraulic motor is led to flow back towards the pump, still with a variable flow rate.

Thus, the connection between the hydraulic motor 24 and the hydraulic pump 25 is a hydrostatic transmission when the actuation means is engaged and the motor and the pump therefore operate in a closed loop.

The rotational speed of the intermittently driven rotor is constantly controlled by the hydraulic pump, whether in the acceleration period, or in the deceleration period. The law of motion of the hydraulic motor is directly related to the flow rate of the oil admitted in the hydraulic motor. Except for the oil leakages and compressibility, the law of motion of the motor 25 is directly based on the law of flow rate of the pump 24 imposed by the geometry of the cam surfaces 31.

During the compression and exhaust phases, the front and rear chambers of the hydraulic motor are isolated from one another by the rotating valve, which enables the mobilization of the rotor 8. On the other hand, during the explosion and intake phases during which the movement of the rotor 8 must be interrupted, the rotating valve ensures the communication between the front and rear chambers of the hydraulic motor 25 and the inlet and outlet of the pump 24.

The rotating valve establishes a hydraulic communication between the conduits 29A and 29B, which creates a hydraulic shunt. This communication is interrupted during the compression and exhaust phases.

A conduit 29A or 29B is associated with each cylindrical chamber 27, depending upon whether this chamber 27 is connected to the internal volume of one of the working chambers forming the front chamber of the motor 25 or to the internal volume of one of the working chambers forming the rear chamber of this motor. Therefore, two conduits 29A and two conduits 29B are formed. Each conduit 29A or 29B is positioned, on the one hand, between the associated chamber 27 and the corresponding working chamber and, on the other hand, between said chamber 27 and the rotating valve. These conduits 29A, 29B are provided in the rotor of the pump. The two conduits 29A are diametrically opposed. The conduits 29B are arranged in a similar manner.

This rotating valve is, for example, constituted by a disk 32 which constitutes the bottom of a cylindrical chamber 32A fixed to the engine unit, coaxially thereto, in which four tubular cylindrical end pieces 33 penetrate so as to extend the four conduits 29A, 29B, respectively, in the volume of the chamber. The end pieces are mounted with a close sliding fit in their respective conduit, and a resilient member is associated with each of them to maintain it in contact with the disk. The end pieces 33 of the conduits 29A are diametrically opposed, so are the end pieces for the conduits 29B. The end pieces of the conduits 29 A can be angularly offset by 90° with respect to those of the conduits 29B. With respect to the disk, the two end pieces 33 associated with the conduits 29A move about a common circular orbit that is different from the common orbit about which the end pieces of the conduits 29B move. On each of the circular orbits of the end pieces 33 of the conduits 29A, 29B, the disk has two diametrically opposed grooves 34 which extend along an arc of circumference substantially equal to 90°. The grooves provided about one of the two orbits are offset by 90° with respect to the grooves 34 provided about the other orbit.

The disk of the rotating valve is wedged angularly with respect to the motor such that the beginning of the intake and explosion phases coincides with the positioning of the end pieces 33 on the upstream end of the grooves 34. The external diameter of each end piece 33 is greater than the width of each groove, such that the end piece 33, when opposite the groove, slides on the edges of the latter. Each end piece 33 is opposite one of the grooves on its orbit during the explosion and intake phases, as a result, the conduits 29A and 29B are in communication with one another by means of the volume of the cylindrical chamber 32A and the grooves 34. During the compression and exhaust phases, the end pieces 33 are spaced angularly from their respective groove 34 and are blocked by the planar surface of the disk 32, which interrupts the communication between the conduits 29A and 29B.

It is obvious that this hydraulic valve is only provided by way of example, and that any other hydraulic member adapted to the function can be used, in particular those shown in FIGS. 17, 18, 61, 61*b* is, 64, 65 and described hereinafter.

Figure 9:
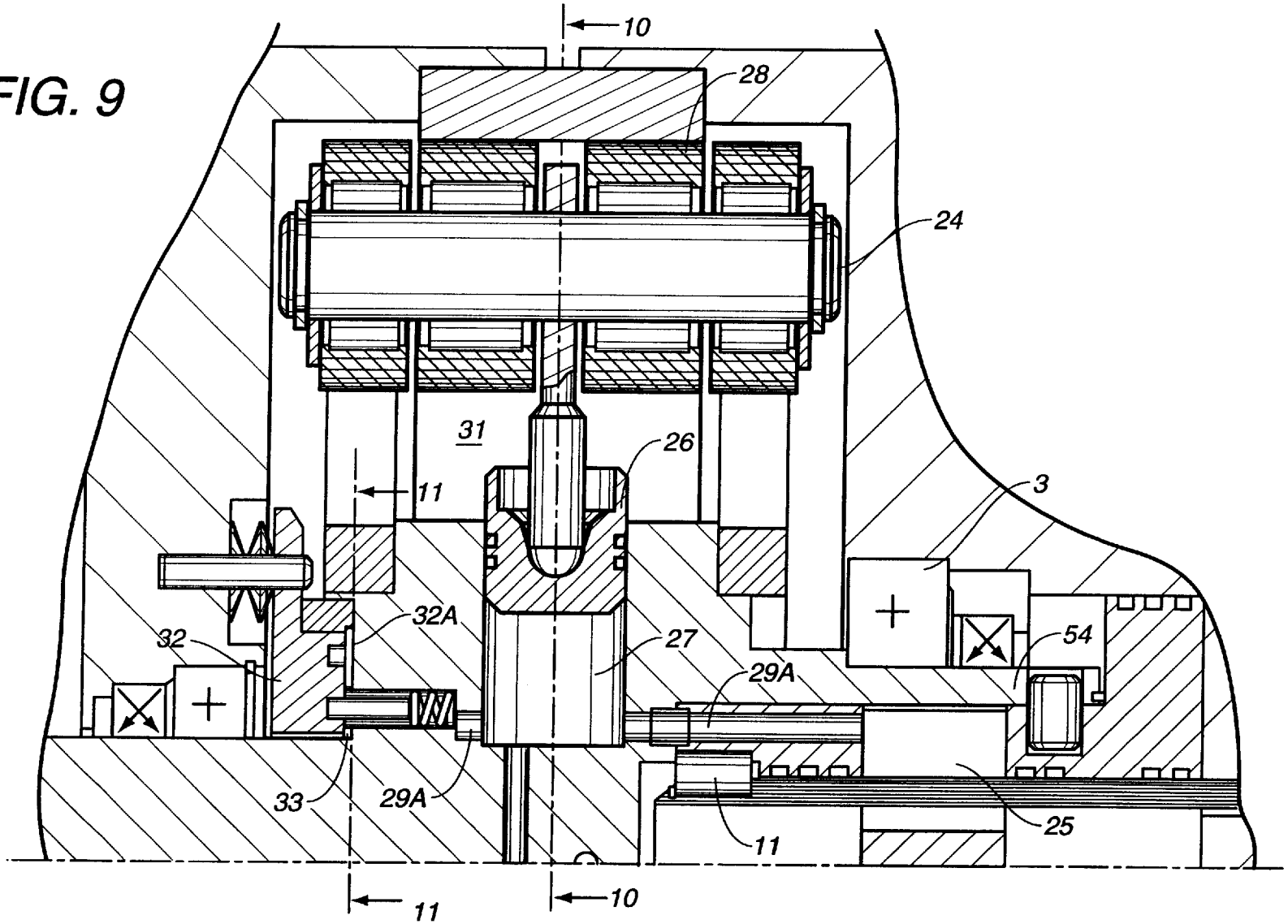
FIG. 9 is a cross-sectional half-view of the movement transmission means.
Figure 10:
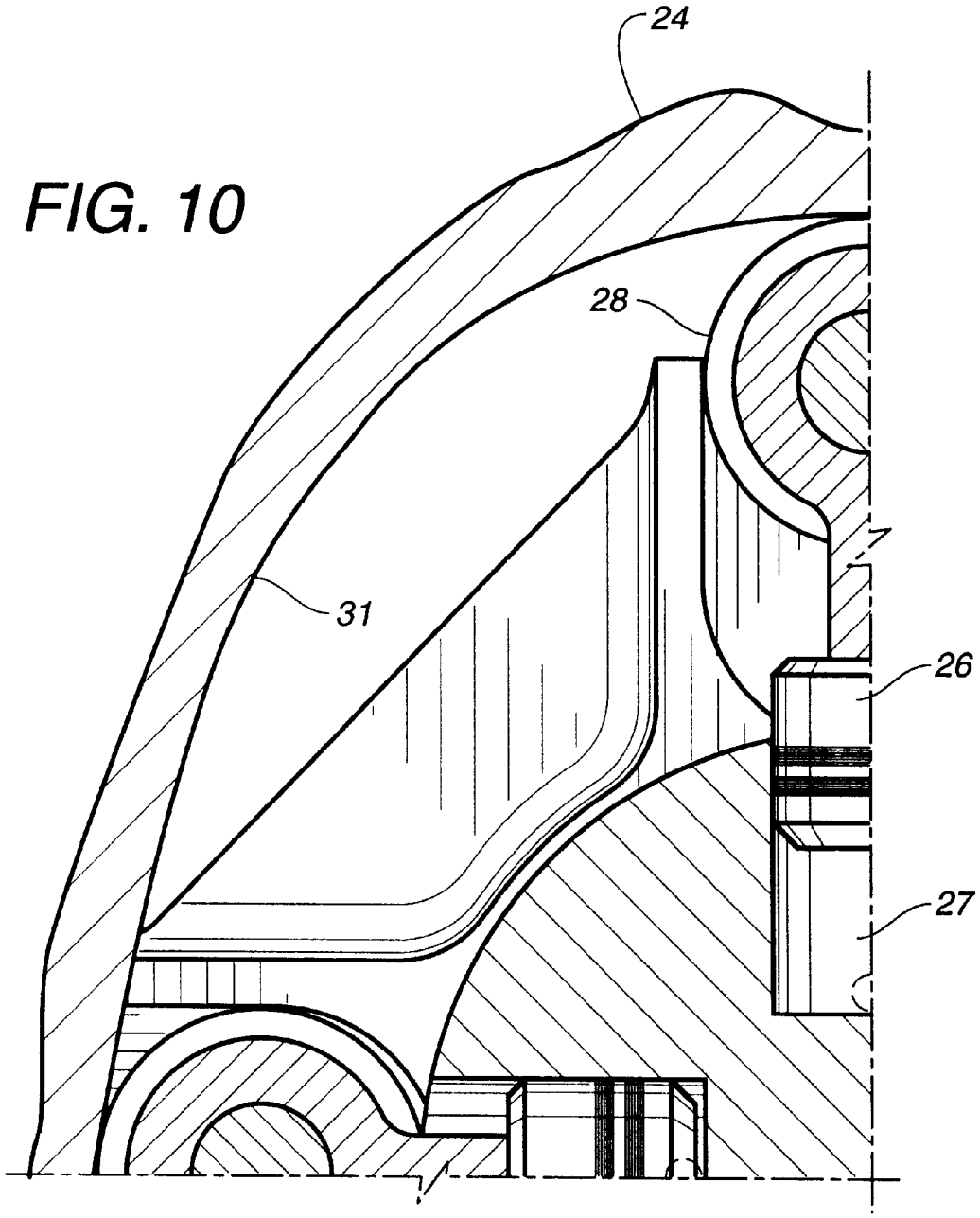
FIG. 10 is a partial cross-sectional view along the line 10—10 of FIG. 9.
Figure 11:
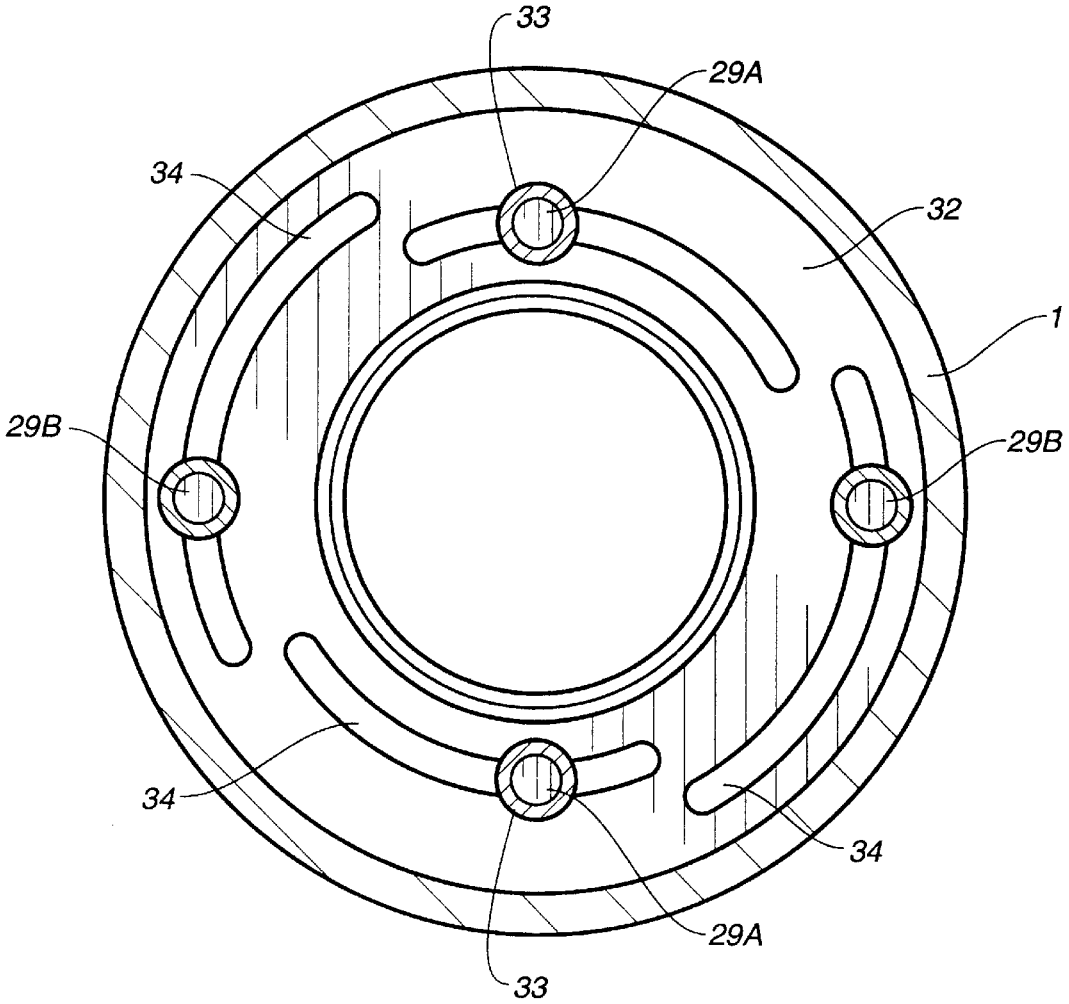
FIG. 11 is a cross-section along the line 11—11 of FIG. 9.
Figure 12:
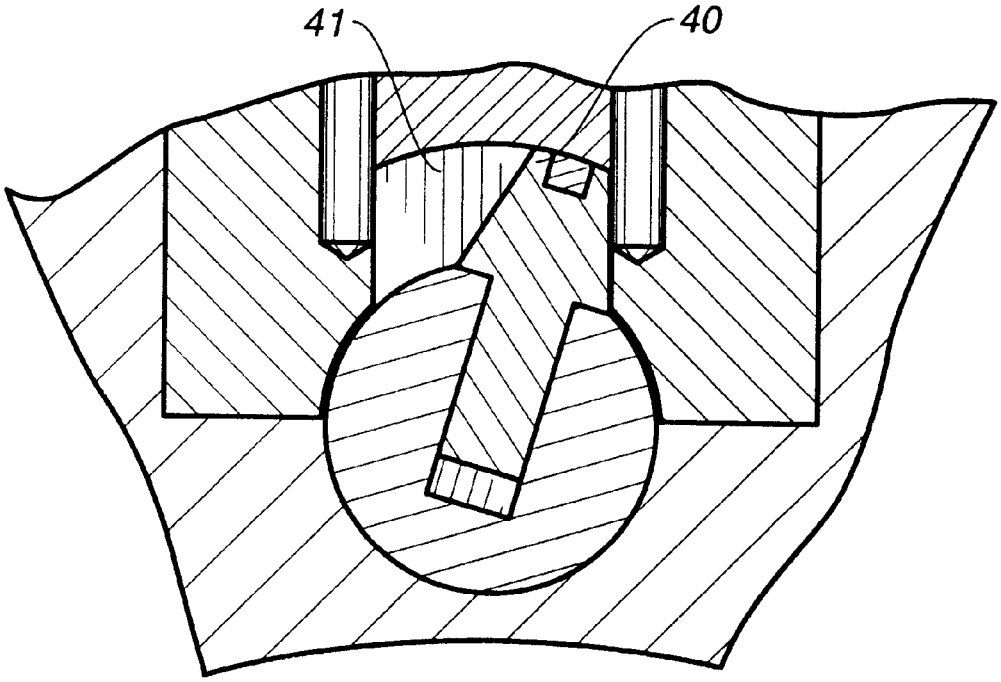
FIG. 12 is a detailed cross-sectional view along the line 12—12 of FIG. 3.

We have previously described a hydraulic motor and a hydraulic pump axially offset as can be seen in FIG. 9, but in a variation, as shown in FIGS. 60 and 61, the motor is housed in the pump and is formed in the rotor of the latter. Thus, the conduits 29A and 29B extend radially from the corresponding capsulings of the hydraulic motor towards the corresponding chambers 27 of the pump.

As can be seen in this Figures, the stator of the pump forms an impervious housing in which the rotor of the pump moves rotationally. In addition, the impervious housing is filled with oil. In FIGS. 60 and 61, it is noted that the pistons do no longer comprise any roller 28, but each comprises a sliding pad 70 adapted to slide on the concave cam surfaces 31 that are preferably provided in an internal crown 24A of the stator of the pump 24. This crown, as can be seen in FIG. 61, comprises two lateral surfaces 24B perpendicular to the axis of rotation of the rotor.

Each sliding pad 70 has a spherical cap-shaped convex surface 71 which comes into support in a substantially conical flaring 72 provided in the piston 26. This arrangement allows the pivoting of the pad with respect to the piston.

The sliding pad 70 is provided with two parallel flanks 73 positioned on both sides of the crown 24A, in sliding contact with the two lateral surfaces 24B of the latter.

The sliding pad 70 further comprises two parallel support lips 74, spaced from one another, each extending continuously from one flank 73 to the other. These two lips, normal on the flanks 73, provide therebetween either a depression or a planar portion in which opens a channel 75 crossing the sliding pad 70 right through to open in the spherical cap-shaped surface of the latter. The piston 26, along its axis, is also crossed right through by an axial channel 76 that opens in the chamber 27, on the one hand, and in the flaring 72, on the other hand. Due to this arrangement, pressurized oil can be inserted between the piston and the pad, on the one hand, and between the pad 70 and the cam surface 31, between the two lips 74, on the other hand. This arrangement reduces the intensity of the resultant of the forces generated by the oil pressure exerted on the assembly constituted by the pad 26 and the piston 70, on the one hand, and on each of the two elements 26 and 70, on the other hand, and creates a hydrostatic balance of these elements.

The rotor of the pump is equipped with two disk-shaped flanks 77 which come to be positioned on both sides of the internal crown 24A. At the level of each piston 26/sliding pad 70 assembly, the flanks 77 of the rotor of the pump are each equipped with a radial opening 78 between the edges of which the sliding pad 70 is mounted through one of its flanks 73. The rear edge of each opening 78, considering the direction of rotation of the rotor of the pump, comes into contact with the corresponding flank 73 of the pad. To be capable of pivoting freely while remaining in contact with the corresponding rear edge, each flank 73 of the sliding pad 70 assumes the contour of an arc of circumference of a circle.

Thus, the sliding pad is guided, on the one hand, by the lateral flanks 24B of the crown 24A and, on the other hand, by the edges of the radial openings 78 of the flanks 77.

The rotating valve of the pump according to this embodiment is constituted by the circular crown 24A, on the one hand, and by the sliding pad, on the other hands. Two diametrically opposed grooves are dug in the circular crown 24A, from each of the lateral surfaces 24B, each of these grooves contiguous to a cam surface 31 and extending parallel to the corresponding cam surface. The two grooves 24C dug in the crown, from one of its lateral surfaces 24B, are offset by 90° with respect to the grooves 24C dug in the crown 24A from the other lateral surface. The grooves are arranged on the orbits of the flanks 73 of the sliding pad 70.

The two grooves of one of the lateral surfaces 24B are adapted to cooperate with the systems of chambers 27 and pistons 26 assigned to controlling the mobilization of the rotor 8' of the hydraulic motor. The other two grooves are adapted to cooperate with the other two systems, the latter being in relation with the rear chambers of the hydraulic motor and being assigned to the mobilization of the rotor 8' during the decelerating phase thereof.

The grooves adapted to cooperate with the systems assigned to the mobilization of the rotor 8' are respectively contiguous to the two cam surfaces cooperating, during compression and exhaust, with the two systems assigned to the control of the deceleration, whereas the two grooves adapted to cooperate respectively with the two systems assigned to the control of the deceleration are respectively contiguous to the two cam surfaces cooperating with the other two systems during the compression and exhaust phases. On the side of their respective grooves, the systems in the corresponding flank 73 of their sliding pad 70 are each provided with a cut 73A that ensures the communication between the groove and the interval between the support lips 74. The functioning of this rotating valve is consistent with that described previously.

The cam surfaces 31 of the rotary piston pump according to the two embodiments preferably ensure a sinusoidal variation in the volume of the working chamber formed by each piston 26/chamber 27 assembly. During the intake and explosion phases, the instantaneous volume variation in the front and rear chambers of the hydraulic motor is constant, whereas the instantaneous volume variation in the aforementioned working chambers is sinusoidal.

Thus, the flow balance in the assemblies constituted respectively by the systems and the associated front or rear chambers of the hydraulic motor, is first negative during the intake and explosion phase (discharge of oil), then is positive with respect to the assemblies comprising the front chambers of the hydraulic motor, and is negative with respect to the other assemblies. This is not a hindrance since during the aforementioned phases, the various assemblies are in communication, by means of the grooves, with the internal volume of the impervious housing formed by the stator of the pump. Thus, the excess of oil in the assembly considered will be poured in the impervious housing, while the oil shortage will be compensated from the impervious housing of the stator under the action of the vacuum prevailing in said assembly.

To facilitate the oil intake in the various assemblies and to avoid a too substantial vacuum in each of them, a channel provided in the rotor of the pump, from one of the external surfaces thereof towards the corresponding cylinder 27, for example, is provided for each of them. A non-return valve is associated with this channel to prevent any back flow of the oil through the channel from the cylinder 27 towards the impervious housing.

A discharge of oil for the two other assemblies corresponds to the intake of oil in the two assemblies comprising the front chambers of the hydraulic motor. This discharge of oil, which occurs from these assemblies towards the impervious housing, is utilized to create a counterpressure in the rear chamber(s) of the motor and to prevent, especially during the gas intake phase, the rotation of the rotor 8', and thereby the rotation of the rotor 8 which may occur due to a vacuum prevailing in the motor capsuling during intake, when the thermal engine is idle or decelerated. This counterpressure can be created, for example, by a pressure relief valve arranged on the circuit for discharging the oil towards the impervious housing.

Preferably, the beginning of the compression phase for the thermal engine, and therefore the beginning of the pressurization of the front chambers of the hydraulic motor correspond to the evenness of the absolute value of the oil flow rate exiting the systems assigned to the mobilization of the rotor 8' with the absolute value of the flow rate of the oil that can be introduced in the front chamber of the hydraulic motor. In this way, the rotor 8' can be started without jerks.

For each working chamber, the four phases of the thermodynamic cycle are accomplished in one complete revolution, each phase corresponding to about a quarter revolution of the rotor 5', the rotor making a stop during the intake phase, a half-turn rotation during the compression phase, a stop during the ignition-explosion or combustion-explosion phase, and a half-turn during the exhaust phase.

According to a first embodiment, as can be seen in FIGS. 1 and 20–42, the same phases of the thermodynamic cycle are accomplished in the two working chambers.

Figure 42:
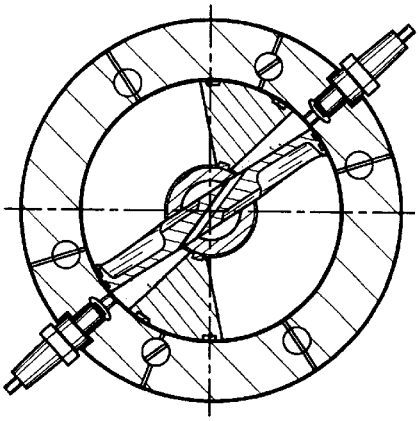
Figure 40:
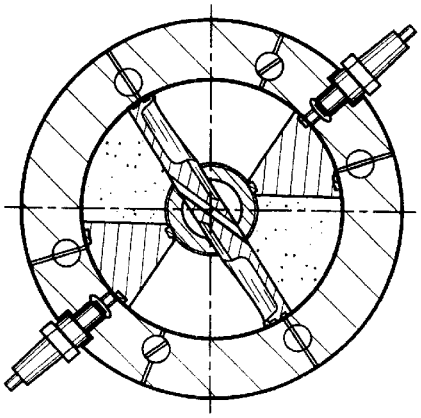
Figure 43:
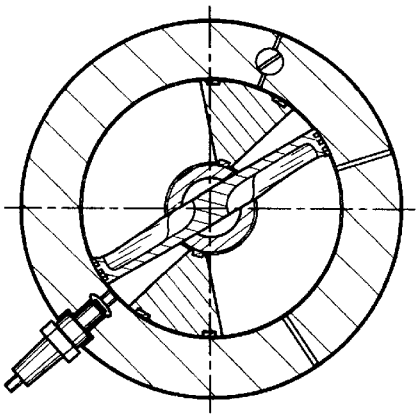
Figure 46:
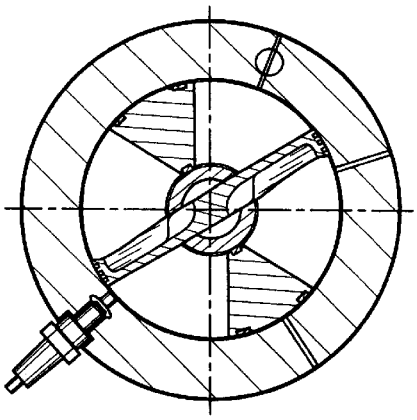
Figure 44:
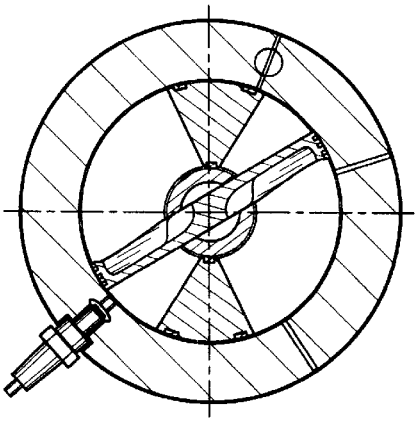
Figure 47:
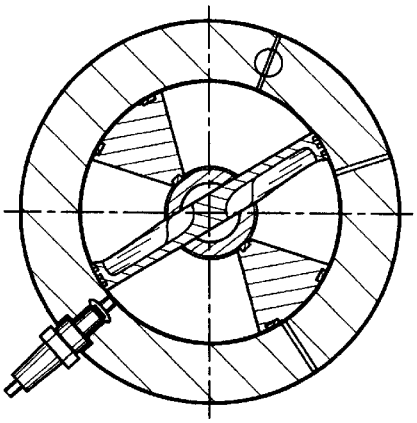
Figure 45:
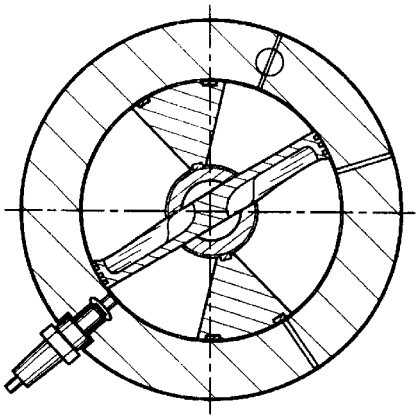
Figure 48:
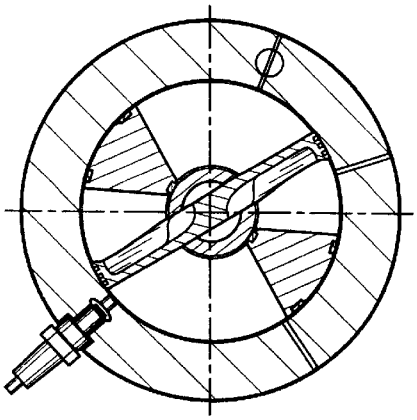
Figure 49:
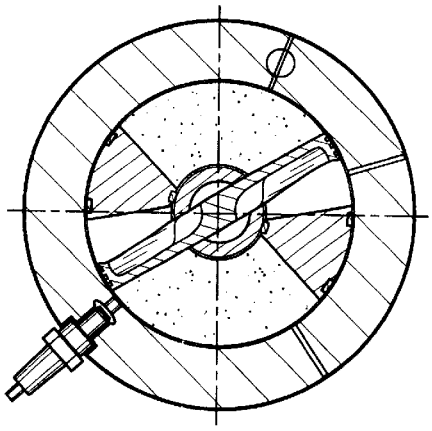
Figure 52:
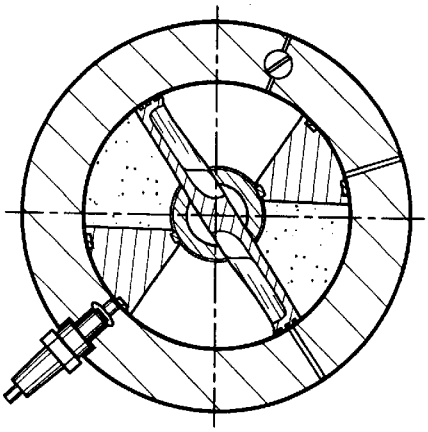
Figure 50:
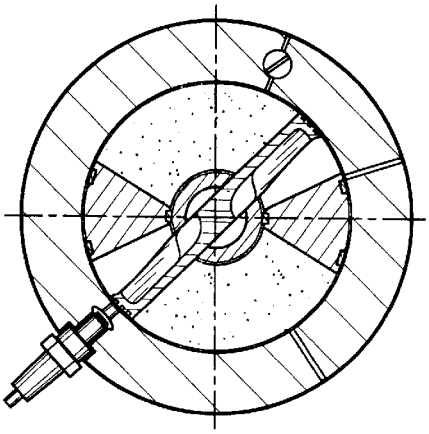
Figure 53:
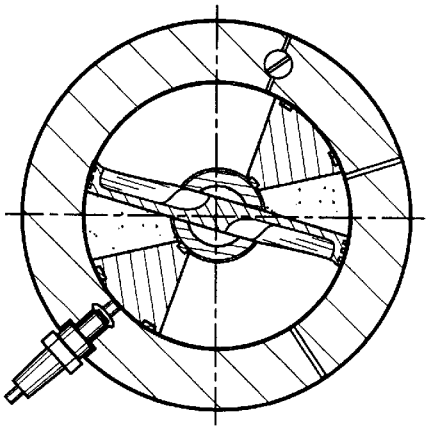
Figure 51:
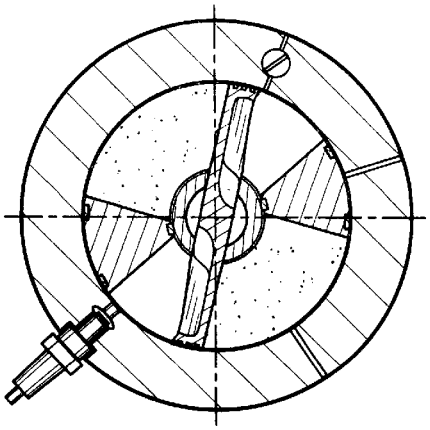
Figure 54:
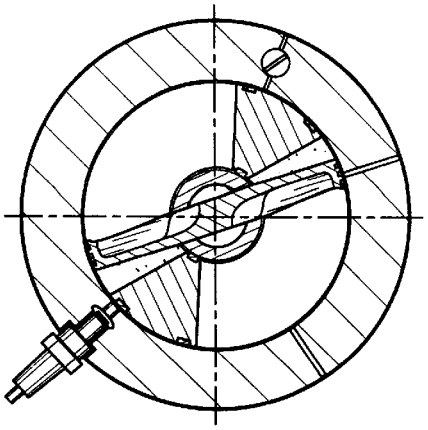

Thus, two diametrically opposed spark plugs 35, two diametrically opposed intake valves 36 and a plurality of diametrically opposed exhaust valves 37 grouped, for example, by pair, are used. The angular position of one of the two pairs of diametrically opposed exhaust valves determines the end of the explosion phase (see FIG. 36), the angular position of the other pair of diametrically opposed valves corresponding to a position that is offset rearwardly by a few degrees with respect to the angular position of the pistons 10 at the end of the exhaust phase (FIG. 42).

In order to balance the pressures, the two working chambers are in communication with one another through an opening 51 provided in the rotor 8, and more specifically in the body of the pistons 10.

Still according to this embodiment, a single pair of working chambers can be provided, or several pairs according to another variation. According to this variation, the pairs of working chambers will be offset axially and separated from one another by impervious partitions, the gas expansion phase in the working chambers of one of the pairs of working chambers being capable of corresponding to the gas intake phase in the two working chambers of the other. According to this embodiment, the separation partitions are radial partitions of the rotor 5, the latter comprising a plurality of pairs of recesses 7 axially spaced apart with or without angular displacement of one with respect to the others, and separated by said radial partitions. The rotor 8 according to this embodiment will be equipped with several pairs of pistons 10 cooperating respectively with the pairs of recesses 7.

According to another embodiment (FIGS. 2, 43–54, and 62, 63), only one spark plug, one intake valve 36 or 79 and one or more exhaust openings are provided. With such a motor, the thermodynamic cycle occurring in one of the two capsulings is offset in phase with respect to the cycle occurring in the other, the four phases of the cycle obtained by the two working chambers being accomplished in half a revolution.

Advantageously, the various valves 36, 37 are controlled in the direction of opening and closing by hydraulic members such as rotating jacks. Each valve can be constituted by an axle mounted rotationally in a cylindrical housing provided in the thickness of the engine unit 1 and transversely to a radial passage 38 provided in the thickness of the wall of the engine unit, this radial passage 38 being either an intake passage or an exhaust passage. The valve will comprise a diametral perforation 39 in the form of a slot that can be aligned with the radial passage 38 or offset angularly with respect to latter in order to create a blocking. The axle constituting the valve comprises, at a distance from the diametral perforation, a piston 40 arranged in a housing 41 of the body 1. This piston 40 divides this housing into two chambers, one front chamber and one rear chamber. A perforation connected to a hydraulic circuit for controlling the position of the valve in relation with the phases of the thermodynamic cycle leads to each chamber.

Each valve can also be constituted by a rotary slide valve 79, as can be seen in particular in FIGS. 62 and 63. This rotary slide valve 79 will be housed in a cylindrical chamber of the engine unit contiguous to the cylindrical chamber 2 and in relation with the latter through communication opening 80 that are alternatively blocked and cleared by the rotary slide valve 79, consistently with the phases of the thermodynamic cycle taking place in the motor working chambers. A motor according to the second embodiment is shown in FIGS. 62 and 63, and the rotary slide valve is associated with intake openings. In FIG. 63, one can see that the rotary slide valve is diametrically opposed to the spark plug, and it is noted that the intake and compression of the gases occur in the cold portion of the motor, which promote the filling. Furthermore, the volume of the gases admitted in the chamber is about 10% greater than the volume of the chamber at the end of the explosion, this can be compared to a natural supercharging.

The gas mixture is first introduced in the chamber of the rotary slide valve 79 and is then introduced in the motor working chambers through the intake openings 80. According to the preferred embodiment, the rotary slide valve 79 is constituted by a recessed cylindrical element comprising, perpendicularly to its axis of revolution, a terminal wall 81 through which it is fixed to a driving shaft 83 rotationally mounted in a bearing and coupled to a gear wheel 84 meshing with a ring gear 85 engaged with the rotor 5. The cylindrical wall of the rotary slide valve comprises a longitudinal opening 82 demarcated by two longitudinal edges.

In the embodiment shown in FIGS. 61 and 63, the angular speed of the rotary slide valve 79 is double that of the rotor 5, and the arc of circumference of the circle separating the two longitudinal edges of the opening 82 has a value of 180°.

Preferably, the introduction of gas in the chamber of the rotary slide valve is carried out axially, and the gases are in introduced in the intake chamber by first allowing it to pass through the recessed rotary slide valve and then through the intake openings.

Advantageously, the rotary slide valve is associated with a lubricating element 86 housed in a cylindrical chamber contiguous to that of the rotary slide valve 79 and in communication therewith. This lubricating element made of a porous and spongy material such as felt is supplied with lubricating oil and is subject to come against the external cylindrical surface of the rotary slide valve 79.

Thus, the rotary slide valve conveys the oil delivered to the gas mixture. This arrangement ensure the lubrication of the motor capsuling(s).

The motor as described comprises a cooling circuit in which a cooling fluid, such as air, is pulsed.

According to the preferred embodiment, the rotor 8 is recessed and its axial perforation constitutes a part of the air cooling circuit. In FIG. 62 or 63, one can see that the motor also comprises a water cooling circuit 95 including a water inlet 96 and outlet 97.

In the body mass of each pair of pistons 10, at least one channel 42 is dug which leads to the axial perforation of the rotor, on the one hand, and to one of the two working chambers not used for the evolution of the gas mixture, on the other hand, this perforation and this capsuling constitute the other part of the cooling circuit. The cooling fluid is evacuated from this working chamber through the exhaust. The channel 42 can be replaced by at least one radial perforation provided in the wall of the rotor 8. Furthermore, a plurality of channels communicating with the radial bore of the rotor will be provided in the core 13A of the non-return mechanism. In this way, the non-return mechanism is also cooled.

Thus, the motor assembly is cooled.

A machine has previously been described which only comprises one motor assembly but includes, in a variation as shown in FIGS. 15–19, and 64–66, a plurality of motor assemblies, as many as three, for example, FIGS. 15–19, arranged in a same engine unit, about a common driving shaft 43 partially arranged in a sealed chamber 44 of the engine unit and rotationally mounted in bearings which are fixedly positioned in the sealed chamber. This driving shaft, exterior to the sealed chamber, receives a gear wheel 45 meshing with ring gears 46 wedged on the rotors 5 of the motor assemblies.

The wheels and the gear are sized such that the driving shaft 43 rotates twice faster than each rotor 5.

According to this embodiment, each motor assembly comprises a hydraulic pump 24 with radial pistons actuated by a rotor, formed on the driving shaft 43, the rotor being common to all pumps 24. Each pump includes two pistons 87, 88 each mounted in a cylinder 27 and arranged along a same plane radial to the shaft 43, each piston being actuated in its cylinder by the rotor of the pump. Each pump feeds the rear chamber of the hydraulic motor 25 of the corresponding motor assembly by means of a rotating joint 52, and the front chamber of the same hydraulic motor 25 by means of a rotating joint 53.

More specifically, the cylinder 27' of one of the pistons is in relation with the rear chamber of the hydraulic motor 25 by means of the rotating joint 52, the other cylinder 27, being in relation with the front chamber of the hydraulic motor 25 by means of the rotating joint 53.

The rotor is formed by two eccentrics 47 and 48 having the same diameter and being axially spaced apart and offset angularly with respect to one another by a 180-degree angle. The two pistons 87, 88 of each pump cooperate with these two eccentrics, respectively and, by rotation of the eccentrics, one of the pistons is actuated in its cylinder 27' in the retraction direction, whereas the other is actuated in its cylinder in the expansion direction. As previously mentioned, the volume variations in the cylinders remain substantially equal in the absolute value.

Each piston is recessed, to reduce the quantity of moving masses, in particular. In the housing formed, the piston receives a compressions spring taking support against the bottom of the cylinder. The displacement of the piston in the direction of the retraction direction therefore occurs against the action exerted by the compression spring. This compression spring further maintains the contact between the piston and the eccentric.

Preferably, the piston, via its rod, comes into support against the cylindrical surface of the eccentric by means of a sliding pad 49, the contacts surfaces between the sliding pad 49 and the associated piston rod having the shape of a spherical cap to allow for the misalignment.

Preferably, a rotating valve common to all pumps is provided on the rotor, this valve being formed by the two eccentrics 47, 48 which, to this end, are each equipped with a groove 50 dug in their cylindrical surface along a fraction of their perimeter. According to this embodiment, each piston rod and the sliding pad 49, aligned with the path of the corresponding groove, are bored right through. According to this embodiment, the sealed chamber 44 is filled with oil. Preferably, the upstream ends of the grooves 50 do not have any angular offset from one eccentric to the other.

During rotation of the driving shaft, the cylindrical chambers 27' of the pistons 87, 88 of each pump, and therefore the front and rear chambers of the corresponding hydraulic motor 25 are brought into communication with one another by means of the chamber 44 and of the grooves 50 when said grooves pass beneath the sliding pad, or are hydraulically isolated from one another when the solid portion of the cylindrical surface of each eccentric 47, 48 comes to block the opening of the sliding pad 49.

The blocking of the opening of the pad 49 occurs during the compression and exhaust phases, this opening being opposite the groove 50 during the intake and explosion phases.

Preferably, the groove 50 of the eccentric assigned to the mobilization of the pistons of the pumps associated hydraulically with the front chamber of the corresponding motor 25 extends along an arc of a circumference of a lesser value than that of the arc of circumference along which the other groove extends. Thus, the front chamber of each motor 25, or motor chamber, is pressurized and supplied before the rear chamber is blocked at the level of the pad 49.

In FIGS. 64, 65 and 66, a thermal machine is shown which is provided with only two engine units. According to this embodiment, the radial pistons 87, 88 of the pumps are maintained against the eccentrics 47, 48 by elastic rings 89 surrounding the rotor common to the radial piston pumps and each cooperating with the piston of one of the pumps and the piston of the other. According to the embodiment shown in these Figures, the recess formed in each piston has a truncated shape.

A stationary plug 90 affixed to the body of the pump penetrates into each piston.

This arrangement reduces the size of the ullages or of the total volume of the compressed oil.

In the embodiment shown in FIGS. 64, 65 and 66, each pump is connected to the corresponding motor by two coaxial and tubular rotating joints 91, 92 mounted in one another. One 91 of the tubular joints is in communication with the rear chambers of the motor, the other being in communication with the front chambers.

The two rotating joints, which have different lengths, are both engaged in the same cylindrical housing 93 of the body of the pump, in which is arranged an impervious separating partition 94 which divides the housing into two compartments 93A, 93B and separates the two rotating joints 91, 92, from one another. One of the compartments of the housing is in communication with one 91 of the joints and with one of the cylinders 27' of the pump, on the one hand, while the other compartment is in relation with the other joint and with the other cylinder, on the other hand.

The hydraulic pump, in its various embodiments, comprises at least one motor system constituted by one piston 26 and one cylinder 27 associated with the front motor chamber of the hydraulic motor and forming, together with the front chamber, a motor hydraulic circuit, and a control system constituted by another piston 26 and another cylinder 27, associated with the rear chamber of the hydraulic motor and forming, together with this rear chamber, a control hydraulic circuit. Advantageously, at least one calibrated means is provided for the automatic discharging of one of the circuits when the pressure in the other reaches a predetermined setting value. Preferably, one calibrated means is provided per hydraulic circuit.

Each calibrated means, as can be seen in FIG. 64, and schematically in FIG. 67, is essentially constituted by a pilot operated valve 99 with a calibrated spring 100, this valve being associated with the pressurized circuit by means of its pilot, and comprises a piston 101 which is axially displaceable in a cylinder 102 under the effect of a hydraulic thrust against the action exerted by an elastic return member constituting the calibrating element. Furthermore, the piston comprises a diametral perforation 103 which, when the piston is pushed back in the cylinder by an action equal to or greater than the calibrating value, is positioned opposite radial perforations 104 provided in the cylinder wall, one of which is in relation with the hydraulic circuit to be discharged and the other is in relation with this discharge. Each hydraulic pump 24 according to the embodiments of FIGS. 16–19, and 64 and 66, can include a device for the admission of oil in the associated or suralimentation hydraulic circuit, when the latter is subjected to a vacuum.

Advantageously, this device is constituted by a non-return intake valve 98. This valve is in relation with the internal volume of the pump, on the one hand, and with an opening for supplying the oil, on the other hand. The oil can be pressurized.

In FIG. 64, one can note that the valve 98 is mounted in a housing for the plug 90. One can also see that this plug is axially bored right through from the housing of the valve.

Finally, it must be noted that the command and control circuits will be equipped with all necessary safety elements. Thus, one can provide pressure relief valves associated with each circuit for discharging them when the hydraulic pressure is too substantial.

It is understood that the present invention can receive any arrangements and variations within the field of the technical equivalents, without leaving the scope of the present application.

I claim:

1. A machine usable as a thermal engine comprising:

an engine unit having a cylindrical chamber, said engine unit having a first rotor and a second rotor coaxially mounted in said cylindrical chamber, said rotors and said chamber forming a working chamber which rotates about a longitudinal axis of said cylindrical chamber, said first rotor is continuously rotationally driven, said second rotor is intermittently rotationally driven in a same direction as said first rotor;

a transmission means for rotationally actuating said second rotor by transmitting movement between said first rotor and said second rotor, said transmission means comprising:

an engaging member having a non-return mechanism, said non-return mechanism comprising a first element fixed to said engine unit and a second element in engagement with said second rotor, said first and second elements cooperative with each other through an angular blocking during an explosion and intake phase of said engine unit, said angular blocking preventing a reverse movement of said second rotor;

a hydraulic pump having a rotor coupled to said first rotor, said hydraulic pump having a stator coupled to said engine unit;

a hydraulic motor coupled to said second rotor and connected to said hydraulic pump by a hydraulic circuit, said hydraulic circuit being a closed loop or a hydrostatic transmission;

at least one valve means operatively connected to said engaging member, said valve means for partially or totally opening said hydraulic circuit between said hydraulic motor and said hydraulic pump during the explosion and intake phase of said engine unit, said valve means for closing said hydraulic circuit during a compression and exhaust phase of said engine unit, the partial or total opening of said hydraulic circuit for disengaging said second rotor from said first rotor, the closing of said hydraulic circuit for engaging said second rotor with said first rotor.

2. The machine of claim 1, wherein one of said first and second elements of said non-return mechanism is a ratchet wheel comprising at least two diametrically opposed teeth which define two stop positions of said second rotor, another of said first and second elements comprises two diametrically opposed radial pins, each of said pins being movably mounted in a bore from a set-back position to an exiting position, each of said pins engages into a corresponding tooth so as to ensure angular blockage of said second rotor along a direction opposite a direction of rotation of said first rotor, said pins acting as pistons in respective bores such that said pins exit from and engage into the respective tooth by spring action or by hydraulic pressure.

3. The machine according to claim 1, wherein said first element of said non-return mechanism is fixed to said engine unit by a mechanical shock absorbing and dissipating means, said mechanical shock absorbing and dissipating means comprising a plurality of shock absorbing elements uniformly distributed in an annular area between said first element and said engine unit, said plurality of shock absorbing elements being in deformable cells each defined by two radial walls extending in said annular area, one of said radial walls being fixed to said first element, another of said radial walls being fixed to said engine unit.

4. The machine according to claim 1, wherein said first element and said second element of said non-return mechanism form at least one cell in which a volume of oil is confined during the explosion and intake phase to prevent a reverse rotation of said second element.

5. The machine according to claim 4, wherein said first element comprises a chamber in which said second element is mounted, said chamber extending coaxial to said first and second rotors, said chamber being defined by front and rear walls perpendicular to an axis of symmetry of said chamber when spaced apart, said chamber also being defined by a casing wall arranged between said front and rear walls, said second element of said non-return mechanism having a core coupled to said second rotor, said second element having two blades extending radially from said core in a diametrically opposite manner, one of said first and second elements of said non-return mechanism carrying two diametrically opposed sealing members within said chamber, the other of said first and second elements of said non-return mechanism being provided with two diametrically opposed surface sectors with respect to the axis of rotation of said second element, said two diametrically opposed surface sectors being positioned in said chamber, said sealing members being pressed against said surface sectors when said first and second elements are in an angular position of reverse blocking, a surface within said chamber of said casing wall having two diametrically opposed surface sectors with respect to said axis of rotation of said second element, said radial blades being pressed against said two diametrically opposed surface sectors of said surface when said first and second elements of said non-return mechanism are angularly blocked with respect to one another, a spacing between said axis of rotation and said surface sectors of said surface being greater than a spacing between said axis of rotation and said surface sectors of said another element of said first and second elements, said chamber having a volume between said first and second elements which is filled with oil, said blades and said sealing members and said surfaces within said chamber of said first and rear walls and said casing wall forming two diametrically opposed impervious cells filled with oil when in the position of angular blocking of said first and second elements, said oil within said impervious cells opposing a reverse movement of said second element.

6. The machine according to claim 5, further comprising a means for indexing the angular blocking position of said first and second elements with respect to each other.

7. The machine according to claim 6, wherein said means for indexing allows a reverse movement of said second element toward a blocking position while controlling such reverse movement.

8. The machine according to claim 7, wherein said two surface sectors of said surface inside said chamber are adapted to cooperate with said blades.

9. The machine according to claim 5, wherein said blades are slidably mounted in a housing of said core of said second element, said sealing members being borne by said core, said sealing members being spaced angularly from said blades, said surface sectors of said another element of said first and second elements are formed in an inner surface of said casing wall with an angular spacing from said surface sectors of said another element, said surface sectors of said another element being adapted to cooperate with said sealing members.

10. The machine according to claim 5, wherein said surface sectors of said another element being provided on said core of said second element, said blades of said second element being fixed with respect to said core, said sealing members being jouralled to said first element so as to be piloted in their rocking movement toward said core of said second element or away therefrom by at least one cam.

11. The machine according to claim 10, said cam being coupled to one of said piston and said second element of said non-return mechanism.

12. The machine according to claim 1, wherein said hydraulic motor is coupled to said first rotor by a stator, said hydraulic motor being coupled to said second rotor by a rotor, said hydraulic pump transmitting oil to said hydraulic motor so as to cause a relative rotation of said second rotor with respect to said first rotor.

13. The machine according to claim 1, wherein said hydraulic motor comprises one front chamber and one rear chamber connected to said hydraulic pump by said hydraulic circuit, said valve means being a rotating valve which is capable of creating a hydraulic shunt during the intake and explosion phase, said valve means creating said hydraulic shunt by connecting said front and rear chambers of said hydraulic motor to one another.

14. The machine according to claim 13, wherein said pump comprises at least two pistons each movable in an independent chamber, one of said pistons being hydraulically connected to said front chamber of said hydraulic motor, the other of said two pistons being hydraulically connected to said rear chamber of said hydraulic motor, a movement of each of said two pistons being opposite to each other such that the absolute value of instantaneous volume variations in said chambers is substantially equal.

15. The machine according to claim 13, wherein said hydraulic motor has a first rotor and a second rotor mounted in an interpenetration configuration, said first and second rotors of said hydraulic motor being coupled respectively to said first and second rotors of said engine unit, said first rotor of said hydraulic motor comprising two diametrically opposed pistons, said second rotor of said hydraulic motor comprising diametrically opposed pistons, said hydraulic motor comprising four working chambers which are diametrically opposed to each other in a two-by-two arrangement, two of said working chambers having an interior volume which constitutes said rear chamber of said hydraulic motor, the other two working chambers having an internal volume which forms said front chamber, said front chamber of said hydraulic motors defined by faces of said pistons of said rotor of said hydraulic motor and by said pistons of the other rotor of said hydraulic motor, each piston of said rotor of said hydraulic motor having conduits opening on both sides thereof, one of said conduits being a supply conduit and another of said conduits being a delivery conduit.

16. The machine according to claim 1, wherein said hydraulic pump has radial pistons, said hydraulic pump having a stator which forms a sealed housing in which is mounted a rotor, said rotor comprising chambers on said radial pistons which cooperate with cam surfaces affixed to said stator.

17. The machine according to claim 16, wherein each of said pistons of said hydraulic pump comprises a sliding pad adapted to slide on said cam surfaces provided in an internal crown of said stator of said hydraulic pump, said sliding pad having a spherical cap-shaped convex surface which is supported in a substantially conical flaring provided in said piston of said hydraulic pump, said sliding pad being provided with two parallel flanks positioned on both sides of said crown, said sliding pad comprises two parallel support lips which are spaced from one another, each of said support lips extending continuously from one flank of said two parallel flanks to the other of said two parallel flanks, said two parallel support lips having a depression crossing said sliding pad so as to open in the spherical cap-shaped surface of said sliding pad, said piston of said hydraulic pump, being crossed by a channel which opens in said chamber of said piston of said hydraulic pump and in said flaring.

18. The machine according to claim 16, said hydraulic motor being formed in said rotor of said hydraulic pump.

19. The machine according to claim 1, said at least one valve comprising a plurality of valves, each of the valves being controlled in a direction of the opening and closing by the rotation of hydraulic jacks, each valve having an axle with a diametrical perforation mounted rotationally in a cylindrical housing provided in said engine unit and transverse to a radial passage provided in a wall of said engine unit, said radial passage being either an intake or exhaust passage.

20. The machine according to claim 1, said at least one valve comprising a plurality of valves, one of said plurality of valves being a rotary slide valve housed in a cylindrical chamber of said engine unit, said rotary slide valve being contiguous to said cylindrical chamber, said engine unit having communication openings which are alternately blocked and cleared by said rotary slide valve during an operation of said engine unit.

21. The machine according to claim 20, wherein said rotary slide valve has a recessed cylindrical element having a terminal wall perpendicular to an axis of revolution of said slide valve, said rotary slide valve being fixed to a driving shaft through said terminal wall, said rotary slide valve being rotationally mounted in a bearing and coupled to a gear wheel meshing with a ring gear engaged with said first rotor, said cylindrical wall of said rotary slide valve having a longitudinal opening defined by two longitudinal edges.

22. The machine according to claim 20, further comprising a lubricating element operatively connected to said rotary slide valve and housed in a cylindrical chamber contiguous with said rotary slide valve and in communication therewith, said lubricating element being of a spongy material supplied with lubricating oil so as to contact a surface of said rotary slide valve.

23. The machine according to claim 1, further comprising:

a cooling circuit provided by an axial perforation in a shaft of said second rotor, said cooling circuit having at least one channel extending to said axial perforation and to said working chamber.

24. The machine according to claim 1, further comprising at least two diametrically opposed working chambers for receiving a gas mixture in accordance with successive phases of a thermodynamic cycle.

25. The machine according to claim 24, wherein two identical phases of the thermodynamic cycle are carried out in two diametrically opposed working chambers.

26. The machine according to claim 24, wherein the thermodynamic cycle which occurs in one of said working chambers is offset in phase with respect to a thermodynamic cycle occurring in another working chamber.

27. The machine according to claim 24, wherein said two diametrically opposed working chambers are axially offset and separated from one another by an impervious partition, a gas expansion phase in one of said working chambers corresponds to a gas intake phase in the other of said working chambers.

28. The machine according to claim 1, further comprising:

a plurality of motor assemblies arranged in said engine unit about a common driving shaft receiving a gear wheel meshing with ring gears wedges on said first rotor of said plurality of motor assemblies.

29. The machine according to claim 28, wherein said driving shaft is adapted to rotate twice as fast as said first rotor of each of said plurality of motor assemblies.

30. The machine according to claim 29, wherein each of said plurality of motor assemblies comprises a hydraulic pump with radial pistons actuated by a rotor formed on said driving shaft.

31. The machine according to claim 30, wherein said hydraulic pump comprises pistons which are each mounted in a cylinder and arranged along a common plane radial to said shaft, each of said radial pistons being actuated in there respective cylinders by said rotor of said hydraulic pump, said rotor of said hydraulic pump being formed by two eccentrics having a similar diameter and axially spaced apart and offset angularly with respect to one another by a 180° angle.

32. The machine according to claim 31, wherein said chamber of one of said radial pistons of said hydraulic pump is connected with a rear chamber of a corresponding hydraulic motor by a rotating joint, another cylinder of another of said radial pistons being connected with a front chamber of said hydraulic motor by a rotating joint.

33. The machine according to claim 32, said rotating joints of each of the cylinders being coaxially mounted in one another, said rotating joints having different lengths, said rotating joints being engaged in a common cylindrical housing of said hydraulic pump, said cylindrical housing of said hydraulic pump having an impervious separating partition dividing the housing into two compartments so as to separate said rotating joints from one another.

* * * * *